US010294753B2

(12) United States Patent
Cook et al.

(10) Patent No.: US 10,294,753 B2
(45) Date of Patent: May 21, 2019

(54) SHIFTING SLEEVE DEVICE AND METHOD

(71) Applicants: Robert Bradley Cook, Mandeville, LA (US); Glenn Mitchel Walls, Madisonville, LA (US)

(72) Inventors: Robert Bradley Cook, Mandeville, LA (US); Glenn Mitchel Walls, Madisonville, LA (US)

( * ) Notice: Subject to any disclaimer, the term of this patent is extended or adjusted under 35 U.S.C. 154(b) by 365 days.

(21) Appl. No.: 15/349,322

(22) Filed: Nov. 11, 2016

(65) Prior Publication Data

US 2017/0138138 A1 May 18, 2017

Related U.S. Application Data

(60) Provisional application No. 62/254,980, filed on Nov. 13, 2015.

(51) Int. Cl.

| | |
|---|---|
| ***E21B 34/14*** | (2006.01) |
| ***E21B 33/16*** | (2006.01) |
| ***E21B 33/14*** | (2006.01) |
| ***E21B 33/134*** | (2006.01) |
| ***E21B 23/00*** | (2006.01) |
| ***E21B 34/10*** | (2006.01) |

(Continued)

(52) U.S. Cl.

CPC ..... *E21B 34/14* (2013.01); *E21B 23/00* (2013.01); *E21B 23/04* (2013.01); *E21B 33/134* (2013.01); *E21B 33/14* (2013.01); *E21B 33/146* (2013.01); *E21B 33/16* (2013.01); *E21B 34/10* (2013.01); *E21B 2034/007* (2013.01)

(58) Field of Classification Search

CPC ..... E21B 33/134; E21B 33/14; E21B 33/146; E21B 33/16; E21B 34/14; E21B 2034/007

See application file for complete search history.

(56) References Cited

U.S. PATENT DOCUMENTS

| | | | |
|---|---|---|---|
| 3,409,096 | A | 11/1968 | Brown |
| 4,098,335 | A | 7/1978 | Goad |
| 4,290,483 | A | 9/1981 | Lawson |

(Continued)

FOREIGN PATENT DOCUMENTS

| | | |
|---|---|---|
| GB | 1063977 | 4/1967 |

OTHER PUBLICATIONS

International Search Report and Written Opinion dated Feb. 3, 2017 from International Bureau in Applicant's counterpart International Patent Application No. PCT/US2016/61563.

*Primary Examiner* — David J Bagnell
*Assistant Examiner* — Tara E Schimpf
(74) *Attorney, Agent, or Firm* — Jones Walker LLP

(57) ABSTRACT

A downhole shifting sleeve device includes a first segment and a second segment each including a housing, a sleeve, and a seat surface connected to the sleeve. Each seat surface is configured to engage a plug traveling through an inner bore of the device, which transfers the associated sleeve from a first position to a second position. The seat surface of the second segment is formed by a selective seat assembly. When the first sleeve is in the first position, the selective seat assembly is in a retracted position in which an inner diameter of the selective seat assembly is greater than or equal to an inner diameter of the second sleeve. When the first sleeve is in the second position, the selective seat assembly is in a deployed position in which the inner diameter of the selective seat assembly is less than the inner diameter of the second sleeve.

23 Claims, 20 Drawing Sheets

(51) Int. Cl.
*E21B 23/04* (2006.01)
*E21B 34/00* (2006.01)

(56) References Cited

U.S. PATENT DOCUMENTS

| | | | | |
|---|---|---|---|---|
| 5,392,852 | A * | 2/1995 | Laurel | E21B 33/1204 166/153 |
| 5,526,884 | A | 6/1996 | Lembcke | |
| 5,829,523 | A * | 11/1998 | North | E21B 33/16 166/250.14 |
| 8,245,788 | B2 | 8/2012 | Garcia et al. | |
| 8,714,272 | B2 | 5/2014 | Garcia et al. | |
| 9,010,447 | B2 | 4/2015 | Themig et al. | |
| 2012/0085548 | A1 | 4/2012 | Fleckenstein et al. | |
| 2013/0327516 | A1 | 12/2013 | Stingerie et al. | |
| 2014/0041876 | A1 | 2/2014 | Fleckenstein et al. | |
| 2014/0174761 | A1 | 6/2014 | Spencer et al. | |

* cited by examiner

SHIFTING SLEEVE DEVICE AND METHOD

CROSS-REFERENCE TO RELATED APPLICATION

This application claims the benefit of and priority to U.S. Provisional Patent Application No. 62/254,980, filed on Nov. 13, 2015, which is incorporated herein by reference in its entirety.

BACKGROUND

Shifting sleeve devices may be used in the operation of petroleum wells to isolate an annulus behind a tubing or work string, allowing communication to be established later. Shifting sleeve devices may also be used with selective release tools. In these tools, sections are held together by a sleeve that maintains a position of the load bearing apparatus. Shifting the sleeve disengages the load bearing apparatus, thereby allowing the segments of the tool to separate and to release a lower section of the tool. Multiple sleeves may be run into a wellbore.

Shifting sleeve devices are often run into a wellbore using wireline, which increases the costs due to additional tool and set-up requirements. Use of wireline, however, allows multiple sleeves to be run into the same wellbore because the sleeves may be keyed for selective operation by a matching shifting tool. Alternatively, a ball may be dropped into the wellbore to cause the ball to engage a seat of the sleeve that has a diameter smaller than the ball. Subsequent application of pressure in the tubing or workstring causes the sleeve to shift. In shifting sleeve devices having multiple sleeves, the restricted diameter of the seat must be reduced for each additional sleeve to cause each ball to engage only the seat of the sleeve intended to be shifted. This sequential reduction of the diameter of the seat results in an inability to subsequently run tools through the sleeves.

SUMMARY OF SELECTED EMBODIMENTS OF THE INVENTION

A downhole shifting sleeve device configured for attachment to a tubular string within a wellbore. The downhole shifting sleeve device may include an upper segment and a releasable portion. The upper segment may include a housing with an inner bore, a lower suspension member operatively connected below the housing, the lower suspension member including an inner bore. The upper segment may also include an inner sleeve having a sleeve inner bore, the inner sleeve configured to slide from a first position to a second position within the inner bore of the housing. The upper segment may further include a seat assembly slidingly disposed within the inner bore of the housing, with an upper end of the seat assembly attached to a lower end of the inner sleeve. In a retracted position, an inner diameter of the seat assembly is greater than or equal to a diameter of the sleeve inner bore. In a deployed position, the inner diameter of the seat assembly is less than the diameter of the sleeve inner bore to form a seat surface. The releasable portion may be selectively connected within the inner bore of the lower suspension member and within a central space of the seat assembly of the upper segment, with the releasable portion extending below the upper segment. In an engaged position, the releasable portion may engage the inner bore of the lower suspension member and the central space of the seat assembly of the upper segment to maintain the seat assembly in the retracted position. In a released position, the releasable portion may be disconnected from the upper segment to place the seat assembly into the deployed position.

The downhole shifting sleeve device may further include an upper suspension sleeve configured for operative attachment to the tubular string, the upper suspension sleeve including an inner bore. The upper segment may further include a hanging member with a retainer and an inner bore. The hanging member may be selectively connected to the inner bore of the upper suspension sleeve. The housing may be operatively connected below the hanging member, and the inner sleeve may also be slidingly disposed within the inner bore of the hanging member. In the first position, the inner sleeve may maintain the retainer in engagement with the inner bore of the upper suspension sleeve to operatively connect the upper segment to the upper suspension sleeve in an engaged position of the upper segment. In the second position, the inner sleeve may release the retainer from the inner bore of the upper suspension sleeve to place the upper segment in a released position in which the upper segment is disconnected from the upper suspension sleeve.

The downhole shifting sleeve device may further include a plug dimensioned to engage the seat surface of the seat assembly of the upper segment for sliding the inner sleeve from the first position into the second position to transfer the upper segment from the engaged position to the released position. The retainer of the hanging member of the upper segment may include a spherical member, a dart, a tapered insert, or a tapered segment, such as a portion of a dog member or a finger member of a collet.

The releasable portion may include a lower segment having a hanging member with a retainer and an inner bore. The hanging member may be selectively connected to the inner bore of the lower suspension member and the seat assembly of the upper segment. The lower segment may also include a housing operatively connected below the hanging member. The housing may include an inner bore. The lower segment may further include an inner sleeve having a sleeve inner bore, with the inner sleeve configured to slide from a first position to a second position within the inner bore of the hanging member and the inner bore of the housing. The lower segment may further include a seat member slidingly disposed within the inner bore of the housing, the seat member including a restricted diameter inner bore. An upper end of the seat member may be attached to a lower end of the inner sleeve. In the first position, the inner sleeve of the lower segment may maintain the retainer in engagement with the inner bore of the lower suspension member of the upper segment to operatively connect the lower segment to the upper segment in an engaged position of the lower segment. In the engaged position of the lower segment, the hanging member maintains the seat assembly of the upper segment in the retracted position. In the second position, the inner sleeve of the lower segment may release the retainer from the inner bore of the lower suspension member of the upper segment to place the lower segment in a released position in which the lower segment is disconnected from the upper segment. In the released position of the lower segment, the hanging member transfers the seat assembly of the upper segment into the deployed position.

The downhole shifting sleeve device may further include a first plug and a second plug. The first plug may be dimensioned to engage the restricted diameter inner bore of the seat member of the lower segment for sliding the inner sleeve of the lower segment from the first position to the second position to place the lower segment in the released position for disconnecting the lower segment from the upper segment. The second plug may be dimensioned to engage the seat surface of the seat assembly of the upper segment for sliding the inner sleeve of the upper segment from the first position to the second position to place the upper segment in the released position for disconnecting the lower segment from the upper segment. A diameter of the first plug may be approximately equal to a diameter of the second plug.

Alternatively, the releasable portion may include a middle segment and a lower segment each separately releasable. The middle segment may include a hanging member having a retainer and an inner bore. The hanging member may be selectively connected within the inner bore of the lower suspension member and the seat assembly of the upper segment. The middle segment may also include a housing operatively connected below the hanging member. The housing may include an inner bore. The middle segment may also include a lower suspension member operatively connected below the housing, with the lower suspension member including an inner bore. The middle segment may further include an inner sleeve having a sleeve inner bore. The inner sleeve may be configured to slide from a first position to a second position within the inner bore of the hanging member and the inner bore of the housing. The middle segment may further include a seat assembly slidingly disposed within the inner bore of the housing. An upper end of the seat assembly may be attached to a lower end of the inner sleeve. In a retracted position, an inner diameter of the seat assembly is greater than or equal to a diameter of the sleeve inner bore. In a deployed position, the inner diameter of the seat assembly is less than the diameter of the sleeve inner bore to form a seat surface in the middle segment. In the first position, the inner sleeve of the middle segment may maintain the retainer in engagement with the inner bore of the lower suspension member of the upper segment to operatively connect the middle segment to the upper segment in an engaged position of the middle segment. In an engaged position of the middle segment, the hanging member maintains the seat assembly of the upper segment in the retracted position. In the second position, the inner sleeve of the middle segment may release the retainer from the inner bore of the lower suspension member of the upper segment to place the middle segment in a released position in which the middle segment is disconnected from the upper segment. In the released position of the middle segment, the hanging member transfers the seat assembly of the upper segment into the deployed position. The lower segment may include a hanging member having a retainer and an inner bore. The hanging member may be selectively connected within the inner bore of the lower suspension member and the seat assembly of the middle segment. The lower segment may also include a housing operatively connected below the hanging member, with the housing including an inner bore. The lower segment may also include an inner sleeve having a sleeve inner bore, the inner sleeve configured to slide from a first position to a second position within the inner bore of the hanging member and the inner bore of the housing. The lower segment may further include a seat member slidingly disposed within the inner bore of the housing. The seat member may include a restricted diameter inner bore, with an upper end of the seat member attached to a lower end of the inner sleeve. In the first position, the inner sleeve may maintain the retainer in engagement with the inner bore of the lower suspension member of the middle segment to operatively connect the lower segment to the middle segment in an engaged position of the lower segment. In the engaged position of the lower segment, the hanging member maintains the seat assembly of the middle segment in the retracted position. In the second position, the inner sleeve may release the retainer from the inner bore of the lower suspension member of the middle segment to place the lower segment in a released position in which the lower segment is disconnected from the middle segment. In the released position of the lower segment, the hanging member transfers the seat assembly of the middle segment in the deployed position.

The downhole shifting sleeve device may further include a first plug, a second plug, and a third plug. The first plug may be dimensioned to engage the restricted diameter inner bore of the seat member of the lower segment for sliding the inner sleeve of the lower segment from the first position to the second position to place the lower segment in the released position for disconnecting the lower segment from the middle segment. The second plug may be dimensioned to engage the seat surface of the seat assembly of the middle segment for sliding the inner sleeve of the middle segment from the first position to the second position to place the lower segment in the released position for disconnecting the middle segment from the upper segment. The third plug may be dimensioned to engage the seat surface of the seat assembly of the upper segment for sliding the inner sleeve of the upper segment from the first position to the second position to place the lower segment in the released position for disconnecting the upper segment from the upper suspension sleeve. A diameter of the first plug may be approximately equal to a diameter of the second plug and a diameter of the third plug.

The seat assembly of the upper segment and the seat assembly of the middle segment may each include a seat sleeve and a segmented seat housed within an inner cavity of the seat sleeve. The segmented seat may define the inner diameter of the seat assembly. The segmented seat may include a split ring having two or more segments that are separated by a distance in the retracted position and in contact with one another in the deployed position to form the seat surface. Each segment of the split ring may include an outer tapered surface configured to cooperate with a tapered inner surface of the inner cavity of the seat sleeve. The upper segment may further include a spring configured to operatively bias the segmented seat toward the deployed position. The upper segment may further include a spring frame having an outer surface with an upper portion and a lower portion interconnected by a shoulder, with the upper portion of the spring frame affixed to a lower end of the inner sleeve and an upper end of the seat sleeve affixed to the upper portion of the spring frame. The shoulder of the spring frame may engage an upper end of the spring. The spring may be disposed between the seat sleeve and the lower portion of the outer surface of the spring frame. The upper segment may further include a guide having an upper end surface and a lower end surface, with the lower end surface engaging the segments of the segmented seat, and with a lower end of the spring engaging the upper end surface of the guide to bias the guide toward the segmented seat and to bias the segmented seat toward the deployed position.

The downhole shifting sleeve device may further comprise one or more wiper blades disposed around an outer surface of the housing of the upper segment. In another embodiment, the seat assembly of the upper segment includes a flapper assembly having a flapper ball seat pivotally movable between the retracted position and the deployed position.

A downhole shifting sleeve device configured for attachment to a tubular string within a wellbore may include a housing having a housing inner bore, a first segment disposed within the housing inner bore, and a second segment disposed within the housing inner bore. The first segment may include a first sleeve having a first sleeve inner bore, with the first sleeve configured to slide from a first position to a second position within the housing inner bore. The first segment may also include a first seat surface operatively connected to the first sleeve. An inner diameter of the first seat surface may be less than a diameter of the first sleeve inner bore. The first segment may transfer the first sleeve from the first position to the second position when a plug engages the first seat surface. The second segment may include a second sleeve having a second sleeve inner bore. The second sleeve may slide from a first position to a second position within the housing inner bore. The second segment may also include a second seat assembly disposed within the housing inner bore and operatively connected to the second sleeve. In a retracted position, an inner diameter of the second seat assembly is greater than or equal to a diameter of the second sleeve inner bore. In a deployed position, the inner diameter of the second seat assembly is less than the diameter of the second sleeve inner bore to form a second seat surface. The second seat assembly may be in the retracted position when the first sleeve is in the first position and in the deployed position when the first sleeve is in the second position. The second segment may transfer the second sleeve from the first position to the second position when a plug engages the second seat surface of the second seat assembly in the deployed position. In a further embodiment, the first housing may include a fluid port through an outer wall. The first sleeve closes the fluid port in a first position, and the fluid port is open in the second position. Alternatively, the fluid port is open in the first position of the first sleeve, and the first sleeve closes the fluid port in the second position.

A method of using a shifting sleeve device in a wellbore may include the following steps: (a) Providing a shifting sleeve device including an upper segment and a lower segment. The upper segment may include a housing having an inner bore and a lower suspension member operatively connected below the housing. The lower suspension member may include an inner bore. The upper segment may also include an inner sleeve having a sleeve inner bore, with the inner sleeve configured to slide from a first position to a second position within the inner bore of the housing. The upper segment may further include a seat assembly slidingly disposed within the inner bore of the housing. An upper end of the seat assembly may be attached to a lower end of the inner sleeve. In a retracted position, an inner diameter of the seat assembly is greater than or equal to an inner diameter of the inner sleeve. In a deployed position, the inner diameter of the seat assembly is less than the inner diameter of the inner sleeve to form a seat surface of the upper segment. The lower segment may include a hanging member with a retainer and an inner bore. The hanging member may be selectively connected within the inner bore of the lower suspension member and within a central space of the seat assembly of the upper segment. The lower segment may also include a housing operatively connected below the hanging member, with the housing including an inner bore. The lower segment may also include an inner sleeve having a sleeve inner bore, with the inner sleeve configured to slide from a first position to a second position within the inner bore of the hanging member and the inner bore of the housing. The lower segment may further include a seat member slidingly disposed within the inner bore of the housing. The seat member may include a restricted diameter inner bore. An upper end of the seat member may be attached to a lower end of the inner sleeve; (b) Attaching the downhole shifting sleeve device to a tubular string; (c) Running the tubular string with the shifting sleeve device into a wellbore with the inner sleeve of the upper segment and the inner sleeve of the lower segment each in the first position. The inner sleeve of the lower segment in the first position maintains the retainer of the lower segment in engagement with the inner bore of the lower suspension member of the upper segment in an engaged position of the lower segment. The hanging member of the lower segment is disposed within the inner bore of the lower suspension member and the central space of the seat assembly of the upper segment to maintain the seat assembly of the upper segment in the retracted position; (d) Deploying a plug through the tubular string and through the shifting sleeve device such that the plug engages the restricted diameter inner bore of the seat member of the lower segment; and (e) Disconnecting the lower segment from the upper segment by increasing a fluid pressure on the plug to slide the inner sleeve of the lower segment from the first position to the second position in which the inner sleeve of the lower segment releases the retainer from the inner bore of the lower suspension member of the upper segment to disconnect the lower segment from the upper segment, thereby releasing the hanging member from the inner bore of the lower suspension member and the central space of the seat assembly of the upper segment to place the seat assembly of the upper segment in the deployed position to form the seat surface of the upper segment.

The shifting sleeve device may further include an upper suspension sleeve having an inner bore. The upper segment may further include a hanging member having a retainer and an inner bore. The hanging member may be selectively connected to the inner bore of the upper suspension sleeve. The housing of the upper segment may be operatively connected below the hanging member. The inner sleeve of the upper segment may also be slidingly disposed within the inner bore of the hanging member. Step (b) may further include attaching the upper suspension sleeve to the tubular string. In step (c), the inner sleeve of the upper segment in the first position maintains the retainer of the upper segment in engagement with the inner bore of the upper suspension sleeve in an engaged position of the upper segment.

The method may further include the steps of: (f) Deploying a second plug through the tubular string and through the shifting sleeve device such that the second plug engages the seat surface of the upper segment; and (g) disconnecting the upper segment from the upper suspension sleeve by increasing a fluid pressure on the second plug to slide the inner sleeve of the upper segment from the first position to the second position in which the inner sleeve of the upper segment releases the retainer from the inner bore of the upper suspension sleeve to disconnect the upper segment from the upper suspension sleeve.

DETAILED DESCRIPTION OF THE PREFERRED EMBODIMENTS

A shifting sleeve device includes a selective seat that is formed after the device is positioned in a wellbore. The device may include two or more seats each associated with a sliding sleeve, with at least one seat being a selective seat. The seats may have approximately equal inner diameters when formed. Each of the seats is configured to engage a plug traveling through an inner bore of the shifting sleeve device such that the plug seals the inner bore. As a result, a fluid pressure within the inner bore increases until a threshold value is reached and the sleeve associated with the seat is displaced from a first position to a second position to provide a secondary function. The displacement of the sleeve into the second position may also result in the selective seat associated with another sleeve being transferred from a retracted position into a deployed position (i.e., formation of the seat). The sleeve associated with the selective seat may be displaced from a first position to a second position by engaging the selective seat in the deployed position with a plug to seal the inner bore and allowing an increase in fluid pressure to a threshold value. The selective seat allows the shifting sleeve device to provide multiple seats without a progressively reduced inner diameter.

In some embodiments, the secondary function of the shifting sleeve device is a release of a portion of the device. In other words, a portion of the shifting sleeve device is released when the sleeve is displaced from the first position to the second position. FIGS. 1-15 illustrate examples of these embodiments.

Figure 16:
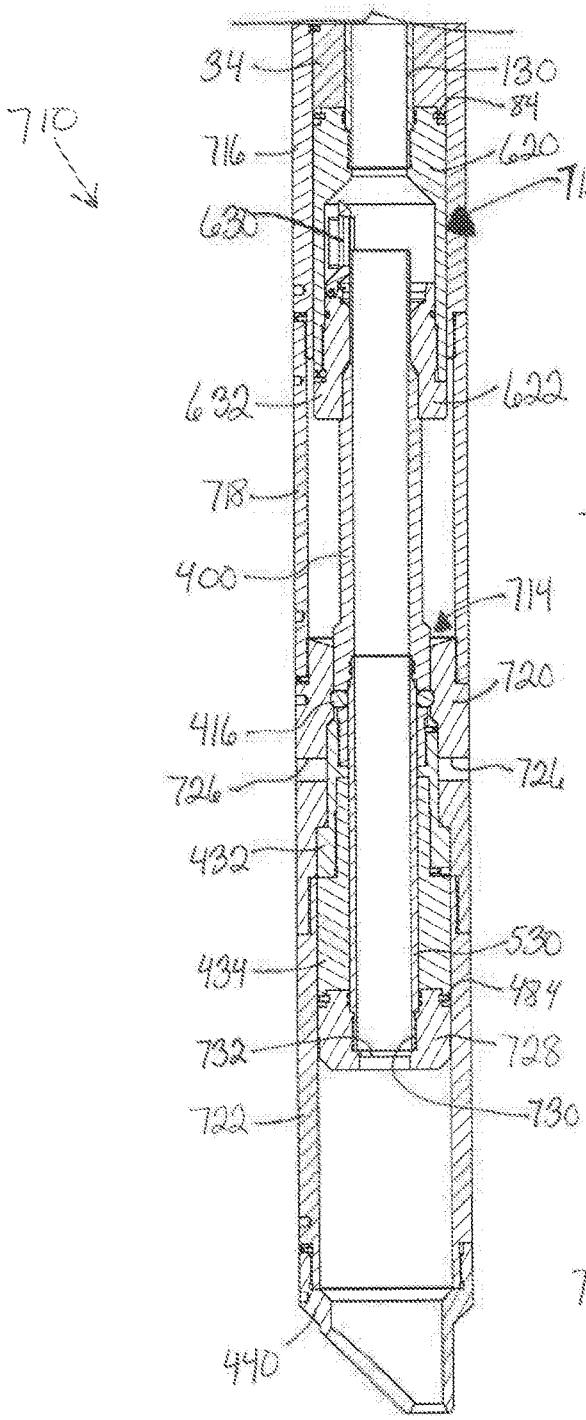
FIG. 16 is a partial sectional view of a second alternate shifting sleeve device including an upper segment and a lower segment, with a sleeve of the lower segment in a first position and with a flapper ball seat of the upper segment in a retracted position.
Figure 17:
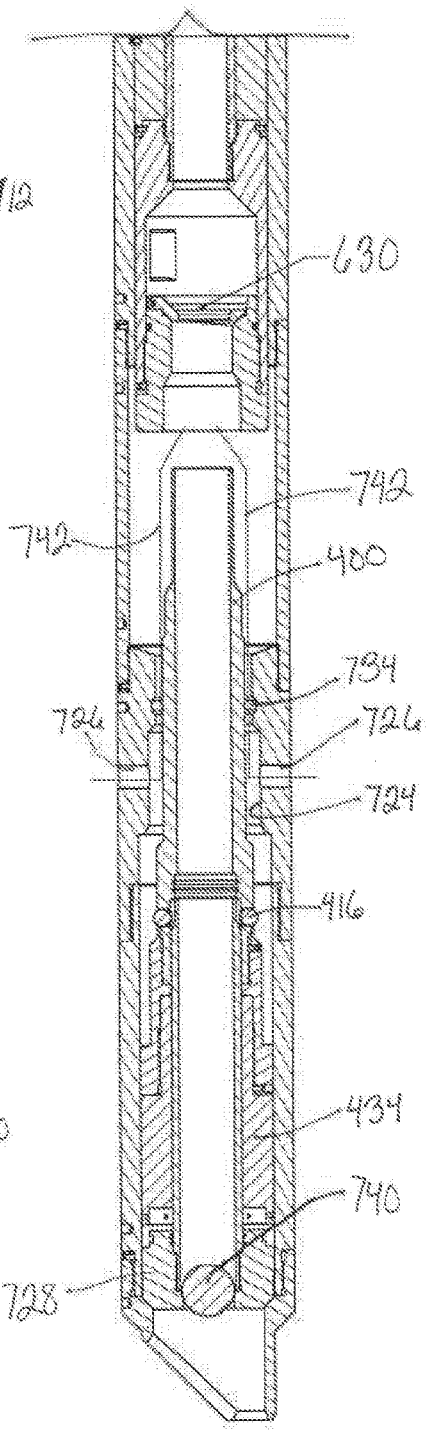
FIG. 17 is a partial sectional view of the second alternate shifting sleeve device with the sleeve of the lower segment in a second position and with the flapper ball seat of the upper segment in a deployed position.

In other embodiments, the secondary function of the shifting sleeve device is opening, closing, or restricting a fluid port of the device. In other words, a fluid port is opened, closed, or restricted when the sleeve is displaced from the first position to the second position. FIGS. 16 and 17 illustrate an example of these embodiments.

Figure 1:
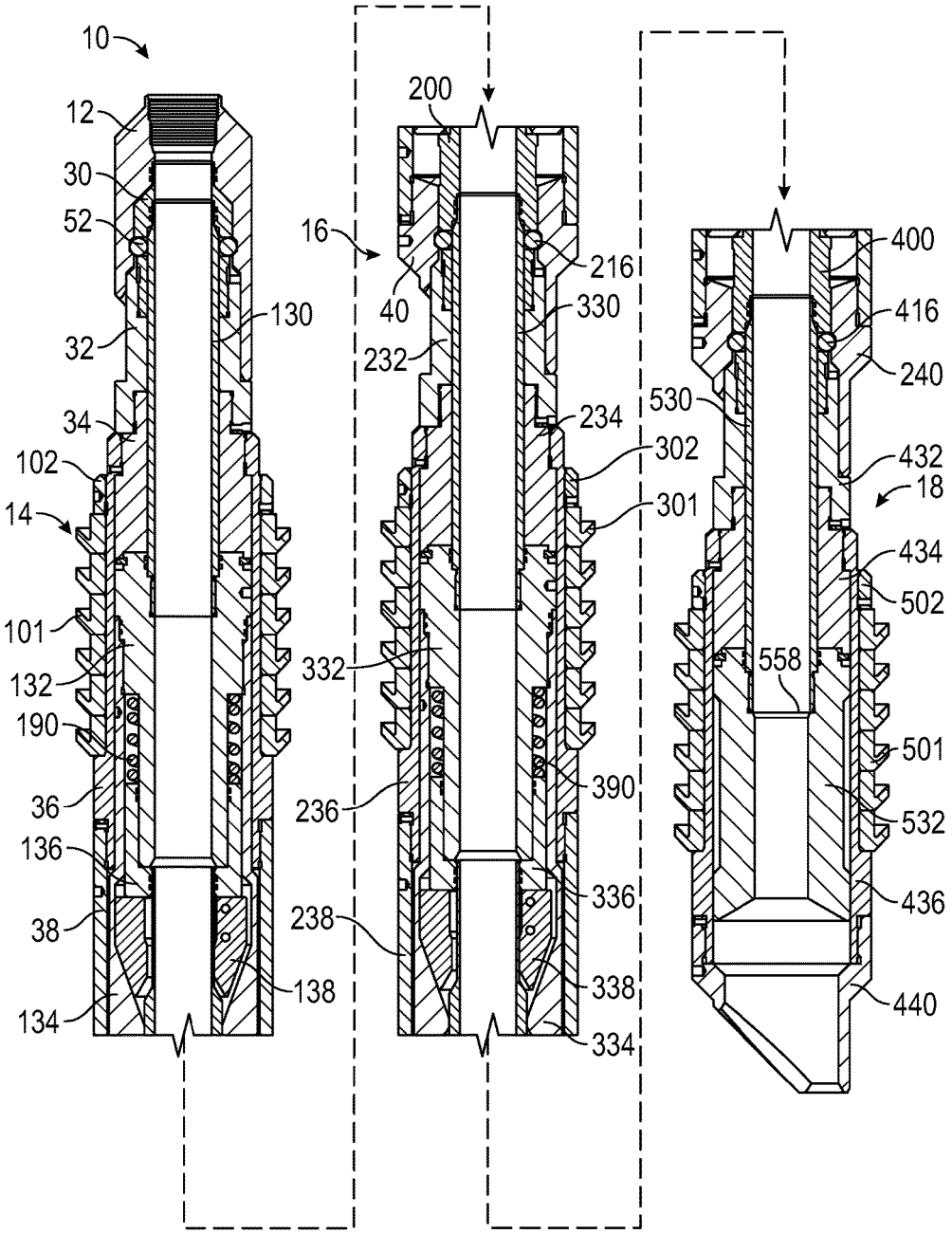
FIG. 1 is a sectional view of a shifting sleeve device including an upper segment, a middle segment, and a lower segment each in an engaged position, and with a segmented seat of the upper segment and a segmented seat of the middle segment each in a retracted position.

FIG. 1 illustrates one embodiment of the shifting sleeve device in which the secondary function is a release of a portion of the device. Shifting sleeve device 10 may include upper suspension sleeve 12, upper segment 14, middle segment 16, and lower segment 18. Upper suspension sleeve 12 may be configured for attachment to a lower end of a tubular string within a wellbore. Shifting sleeve device 10 may be configured to sequentially release lower segment 18, then middle segment 16, then upper segment 14 by dropping a triggering plug through the central bore running through each segment. Shifting sleeve device 10 may also be used in a horizontal wellbore, in which case "upper" or "up" shall be construed to include upstream and "lower" or "down" shall be construed to include downstream.

Figure 2A:
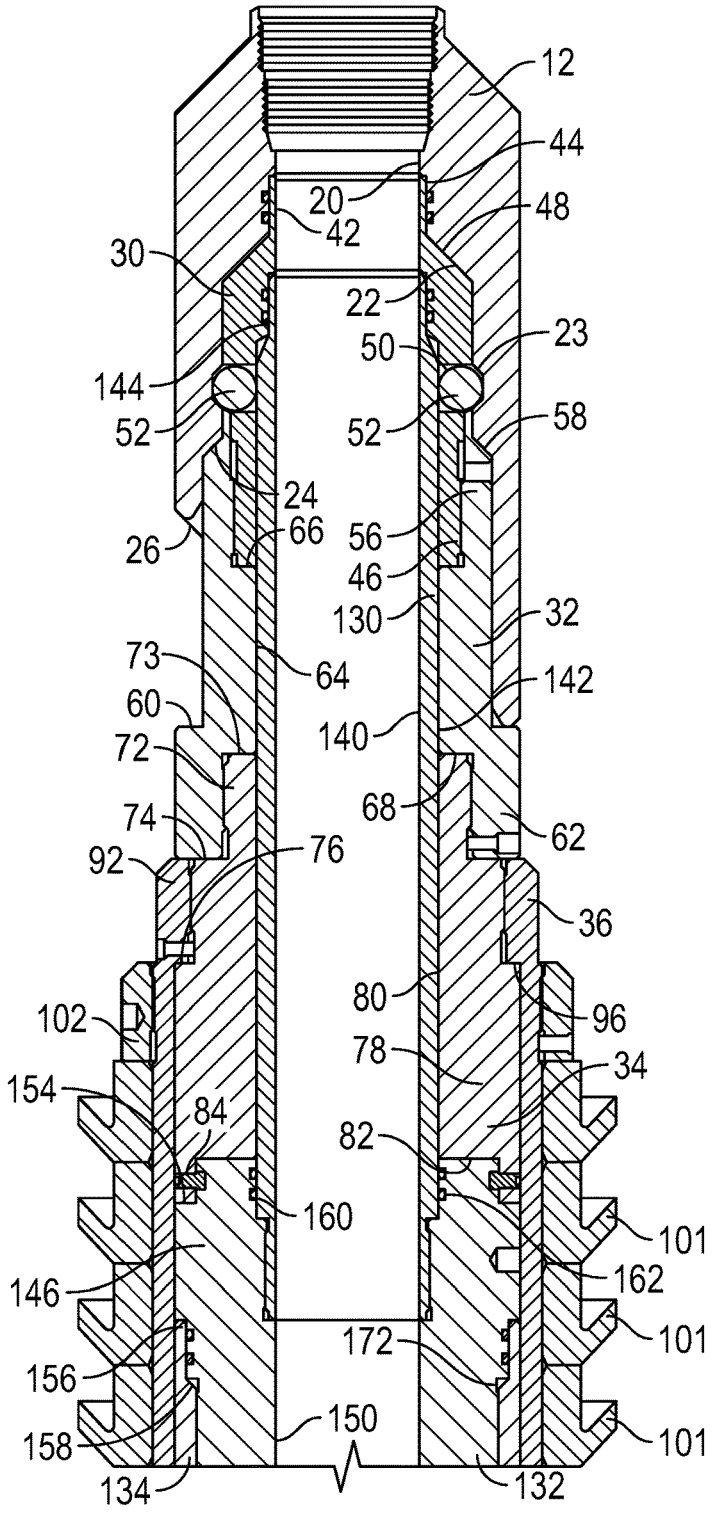
FIGS. 2A-2F are sequential sectional views of the shifting sleeve device in the position shown in FIG. 1.
Figure 2B:
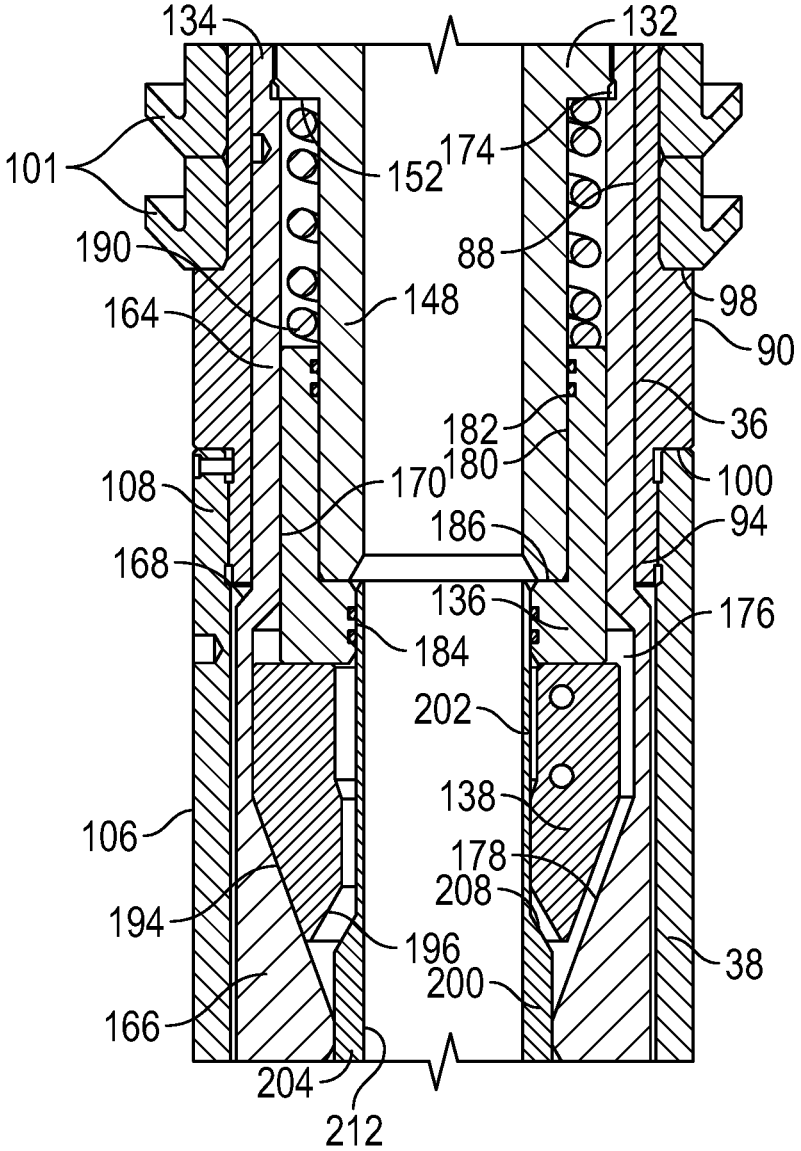
Figure 2C:
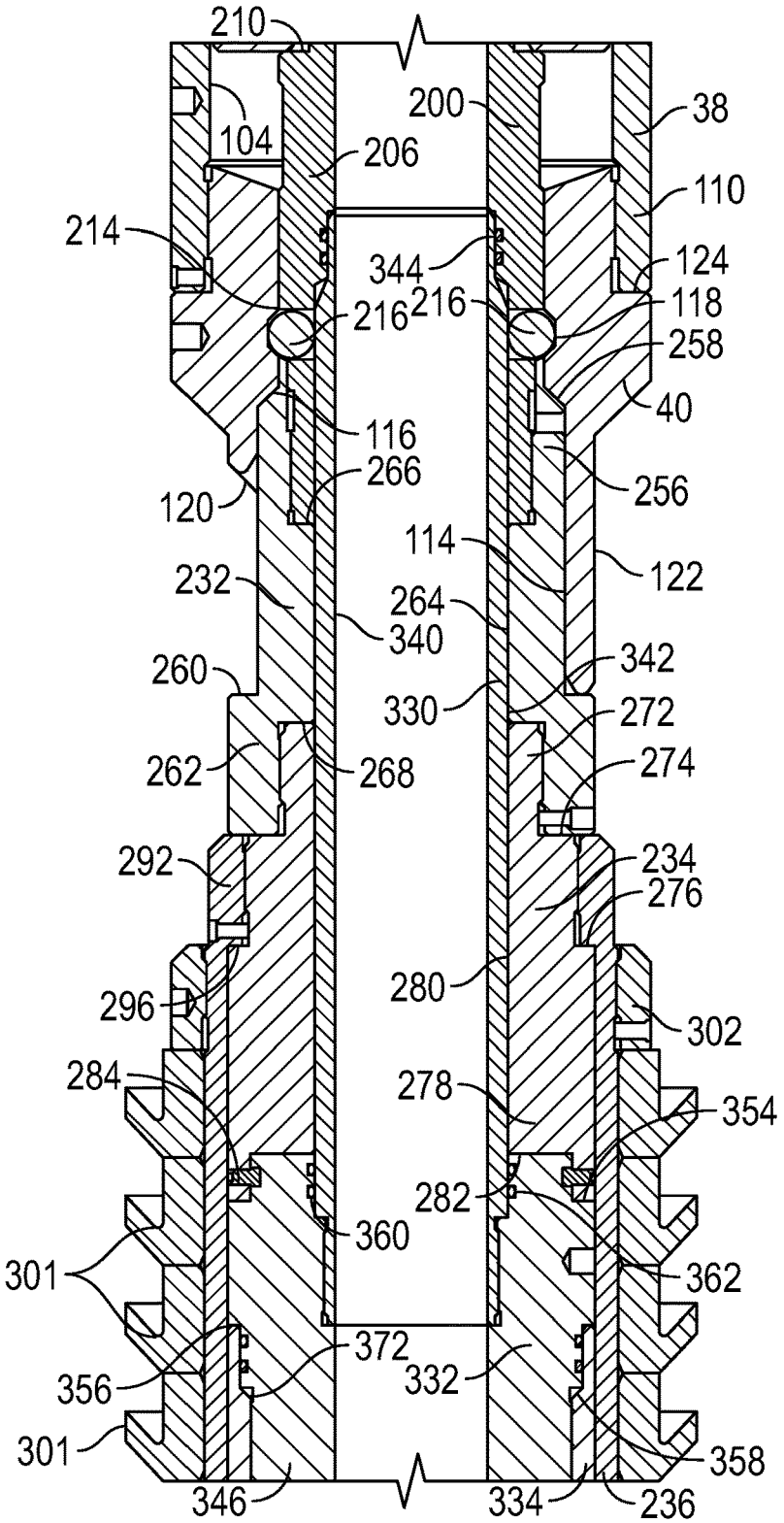

Referring now to FIG. 2A, upper suspension sleeve 12 may include inner bore 20 with tapered shoulder 22, groove 23, and tapered shoulder 24. Groove 23 may have a larger diameter than the surrounding surface of inner bore 20. Upper suspension sleeve 12 may also include tapered end surface 26.

With reference to FIGS. 1 and 2A-2C, upper segment 14 may include hanging member 30, bridge member 32, retaining sleeve 34, housing 36, seat housing 38, and end member 40. End member 40 may also be referred to as a lower suspension sleeve or a lower suspension member. Hanging member 30 may be connected within inner bore 20 of upper suspension sleeve 12. Hanging member 30 may include inner bore 42 extending from upper end 44 to lower end 46. Hanging member 30 may also include tapered shoulder 48 configured to engage tapered shoulder 22 of inner bore 20 of upper suspension sleeve 12. Hanging member 30 may include one or more recesses 50 configured to house retainers 52. Each retainer 52 may engage inner bore 20 of upper suspension sleeve 12 to connect hanging member 30 within inner bore 20 of upper suspension sleeve 12 in a run-in position shown in FIGS. 1 and 2A-2C. In this way, upper segment 14 is retained in an engaged position with upper suspension sleeve 12. Device 10 may include any number of recesses 50 and retainers 52. For example, device 10 may include between one and twenty recesses 50 and between one and twenty retainers 52. In one embodiment, retainers 52 may be formed of spherical elements designed to engage groove 23 in inner bore 20 of upper suspension sleeve 12 to retain hanging member 30 within inner bore 20 of upper suspension sleeve 12. In other embodiments, retainers 52 may be formed of rectangular dogs with tapered edges or a collet with multiple fingers.

Bridge member 32 may include upper end 56 attached to lower end 46 of hanging member 30. Bridge member 32 may also include tapered shoulder 58, shoulder 60, lower end 62, and inner bore 64 extending from upper end 56 to lower end 62. Upper end 56 of bridge member 32 may be connected within inner bore 20 of upper suspension sleeve 12 such that tapered shoulder 58 of bridge member 32 engages tapered shoulder 24 of upper suspension sleeve 12. A portion of tapered end surface 26 of upper suspension sleeve 12 may engage shoulder 60 of bridge member 32. Inner bore 64 may include upper shoulder 66 and lower shoulder 68. Lower end 46 of hanging member 30 may engage upper shoulder 66 of inner bore 64 of bridge member 32. Bridge member 32 may be secured to hanging member 30 through a threaded connection. In one embodiment, a set screw or pin member may engage both bridge member 32 and hanging member 30 to prevent unintentional disconnection between the two components.

Retaining sleeve 34 may include upper end 72 threadedly connected within inner bore 64 of bridge member 32 such that upper end surface 73 engages lower shoulder 68. Retaining sleeve 34 may also include upper shoulder 74, lower shoulder 76, lower end 78, and inner bore 80 extending from upper end 72 to lower end 78. Inner bore 80 of retaining sleeve 34 may include inner shoulder 82 near lower end 78. Lower end 78 may include one or more apertures each dimensioned to receive a pin member 84.

Housing 36 may include inner bore 88 and outer surface 90 each extending from upper end 92 to lower end 94. Inner bore 88 may include shoulder 96 near upper end 92. Outer surface 90 may include first shoulder 98 and second shoulder 100 both near lower end 94 of housing 36. Retaining sleeve 34 may be threadedly connected within inner bore 88 of housing 36 such that lower shoulder 76 of retaining sleeve 34 engages shoulder 96 of inner bore 88. Upper end 92 of housing 36 may engage lower end 62 of bridge member 32. Housing 36 may further include wiper blades 101 secured around outer surface 90 such that the lowest positioned wiper blade 101 engages first shoulder 98. Wiper retaining member 102 may be disposed around outer surface 90 of housing 36 above the highest positioned wiper blade 101 in order to secure wiper blades 101 onto housing 36. Wiper retaining member 102 may be threadedly connected to outer surface 90 of housing 36.

Seat housing 38 may include inner bore 104 and outer surface 106 each extending from upper end 108 to lower end 110. Upper end 108 of seat housing 38 may be threadedly connected around lower end 94 of housing 36. Upper end 108 of seat housing 38 may engage second shoulder 100 of outer surface 90 of housing 36.

End member 40 may include inner bore 114 with tapered shoulder 116 and groove 118, which may have a larger diameter than the surrounding surface of inner bore 114. End member 40 may also include tapered end surface 120. Outer surface 122 of end member 40 may include shoulder 124. End member 40 may be threadedly connected to inner bore 104 of seat housing 38 such that lower end 110 of seat housing 38 engages shoulder 124 of end member 40.

As shown in FIGS. 1 and 2A-2C, a shifting sleeve of upper segment 14 may include inner sleeve 130, spring frame 132, seat sleeve 134, guide 136, and segmented seat 138. These components may be housed within the inner bores of hanging member 30, bridge member 32, retaining sleeve 34, housing 36, and seat housing 38. Segmented seat 138 is one embodiment of a seat assembly.

Inner sleeve 130 may include inner bore 140 and outer surface 142. Outer surface 142 may include upper restricted diameter surface 144. Inner sleeve 130 may be slidingly disposed within inner bore 42 of hanging member 30, inner bore 64 of bridge member 32, inner bore 80 of retaining sleeve 34, and inner bore 88 of housing 36. In the engaged position of upper segment 14 shown in FIGS. 1 and 2A-2C, outer surface 142 of inner sleeve 130 may engage retainers 52, thereby maintaining retainers 52 in engagement with inner bore 20 of upper suspension sleeve 12.

Spring frame 132 may be slidingly disposed within inner bore 88 of housing 36. Spring frame 132 may include upper portion 146, lower portion 148, and inner bore 150 extending through upper and lower portions 146 and 148. Spring frame 132 may also include shoulder 152 between upper portion 146 and lower portion 148. An outer surface of upper portion 146 may include upper shoulder 154, middle shoulder 156, and lower shoulder 158. Upper portion 146 of spring frame 132 may be selectively attached to retaining sleeve 34 such that an upper surface of spring frame 132 engages lower shoulder 82 of inner bore 80 of retaining sleeve 34. In one embodiment, pin members 84 may be disposed through apertures in lower end 78 of retaining sleeve 34 and may engage one or more bores in upper portion 146 of spring frame 132. In this way, pin members 84 may secure spring frame 132 to retaining sleeve 34. Upper portion 146 of spring frame 132 may also be threadedly attached to inner sleeve 130 such that a lower end of inner sleeve 130 is disposed within an upper end of inner bore 150 of spring frame 132. Inner bore 150 of spring frame 132 may include grooves 160 dimensioned to receive seal members 162 to fluidly seal the connection between spring frame 132 and inner sleeve 130. Seal members 162 may be formed of any device capable of providing a fluid seal between two components, such as an O-ring or other elastomeric seal.

Seat sleeve 134 may be slidingly disposed within inner bore 88 of housing 36 and inner bore 104 of seat housing 38. Seat sleeve 134 may include upper portion 164 having a generally tubular shape, lower portion 166 having an expanded outer surface relative to upper portion 164, and outer shoulder 168 between upper portion 164 and lower portion 166. Inner bore 170 of seat sleeve 134 may extend through upper portion 164 and lower portion 166. Inner bore 170 may include first inner shoulder 172 and second inner shoulder 174 in upper portion 164 of seat sleeve 134. Inner bore 170 may include cavity 176 in lower portion 166 of seat sleeve 134. Cavity 176 may have a larger inner diameter than inner bore 170 extending through upper portion 164 of seat sleeve 134. Cavity 176 may include tapered lower surface 178.

Seat sleeve 134 may be threadedly attached to spring frame 132 such that upper portion 164 of seat sleeve 134 is disposed around spring frame 132. In this position, an upper surface of seat sleeve 134 may engage middle shoulder 156 of upper portion 146 of spring frame 132, first inner shoulder 172 of seat sleeve 134 may engage lower shoulder 158 of upper portion 146 of spring frame 132, and second inner shoulder 174 of seat sleeve 134 may engage shoulder 152 of spring frame 132. In this position, upper portion 164 of seat sleeve 134 may be disposed within inner bore 88 of housing 36 and lower portion 166 of seat sleeve 134 may be disposed within inner bore 104 of seat housing 38 such that shoulder 168 of seat sleeve 134 engages a lower surface of housing 36.

Guide 136 may include inner bore 180 having upper portion 182 and lower portion 184 connected by shoulder 186. Guide 136 may be slidingly disposed within inner bore 170 of seat sleeve 134. The lower end of spring frame 132 may be disposed within upper portion 182 of inner bore 180. In this position, a lower surface of spring frame 132 engages shoulder 186 of guide 136.

Spring 190 may be disposed around lower portion 148 of spring frame 132 and within inner bore 170 of seat sleeve 134. An upper end of spring 190 may engage shoulder 152 of spring frame 132, and a lower end of spring 190 may engage an upper surface of guide 136. In this way, spring 190 may bias guide 136 in a downward direction.

Segmented seat 138 may be disposed within cavity 176 of seat sleeve 134. Segmented seat 138 may include two or more segments each having tapered outer surface 194 configured for cooperation with tapered lower surface 178 of cavity 176. Each segment of segmented seat 138 may also include tapered inner surface 196. In a retracted position of segmented seat 138 shown in FIGS. 1 and 2B, the segments of segmented seat 138 are separated by a distance or a space, and an inner diameter of segmented seat 138 may be greater than or equal to a diameter of inner bore 140 of inner sleeve 130. An upper surface of each segmented seat 138 may engage a lower surface of guide 136 such that spring 190 biases guide 136 and each segment of segmented seat 138 in the downward direction toward a deployed position of segmented seat 138 (shown in FIG. 7). In the deployed position, the segments of segmented seat 138 are in contact with one another and the inner diameter of segmented seat 138 may be less than a diameter of inner bore 140 of inner sleeve 130. In this way, segmented seat 138 provides a selective seat of upper segment 14 of shifting sleeve device 10.

With reference now to FIGS. 1 and 2B-2E, middle segment 16 may include hanging member 200, which may have upper portion 202, middle portion 204, and lower portion 206. Tapered shoulder 208 may interconnect the outer surface of upper portion 202 and the outer surface of middle portion 204. Shoulder 210 may interconnect the outer surface of middle portion 204 and the outer surface of lower portion 206. Hanging member 200 may also include inner bore 212 extending through upper portion 202, middle portion 204, and lower portion 206.

In the position shown in FIGS. 1 and 2A-2E, hanging member 200 may be disposed within upper segment 14 to maintain the separation of the segments of segmented seat 138. Specifically, upper portion 202 of hanging member 200 may be disposed through lower portion 184 of inner bore 180 of guide 136 and through a central space between the segments of segmented seat 138. Tapered shoulder 208 of hanging member 200 may engage tapered inner shoulder 196 of each segment of segmented seat 138. In this position, middle portion 204 of hanging member 200 may be disposed through inner bore 170 of seat sleeve 134 with shoulder 210 of hanging member 200 engaging a lower surface of seat sleeve 134. Lower portion 206 of hanging member 200 may be disposed through inner bore 114 of end member 40. In this way, hanging member 200 of middle segment 16 maintains the separation of the segments of segmented seat 138 in the position shown in FIGS. 1 and 2A-2E.

Lower portion 206 of hanging member 200 may include one or more recesses 214 configured to house retainers 216. Each retainer 216 may engage inner bore 114 of end member 40 of upper segment 14 to connect hanging member 200 within inner bore 114 of end member 40 in the run-in position shown in FIGS. 1 and 2A-2E. In this way, middle segment 16 is retained in an engaged position with upper segment 14. Device 10 may include any number of recesses 214 and retainers 216. For example, device 10 may include between one and twenty recesses 214 and between one and twenty retainers 216. In one embodiment, retainers 216 may be formed of spherical elements designed to engage groove 118 in inner bore 114 of end member 40 to retain hanging member 200 within inner bore 114 of end member 40. In other embodiments, retainers 216 may be formed of rectangular dogs with tapered edges or a collet with multiple fingers.

As explained below, the release of hanging member 200 of middle segment 16 from the central space between segmented seat 138 causes guide 136 and the segments of segmented seat 138 to move in a downward direction due to the biasing force provided by spring 190. Because of the cooperation between tapered outer surfaces 194 of each segment of segmented seat 138 and tapered lower surface 178 of seat sleeve 134, the segments of segmented seat 138 move toward one another as the segments move in the downward direction to form a restricted diameter seat (i.e., segmented seat 138 moves from a retracted position to a deployed position).

With reference to FIGS. 1 and 2B-2E, middle segment 16 may also include bridge member 232, retaining sleeve 234, housing 236, seat housing 238, and end member 240. End member 240 may also be referred to as a lower suspension sleeve or a lower suspension member.

Bridge member 232 may include upper end 256 attached to lower portion 206 of hanging member 200. Bridge member 232 may also include tapered shoulder 258, shoulder 260, lower end 262, and inner bore 264 extending from upper end 256 to lower end 262. Upper end 256 of bridge member 232 may be connected within inner bore 114 of end member 40 such that tapered shoulder 258 of bridge member 232 engages tapered shoulder 116 of end member 40. A portion of tapered end surface 120 of end member 40 may engage shoulder 260 of bridge member 232. Inner bore 264 may include upper shoulder 266 and lower shoulder 268. Lower portion 206 of hanging member 200 may engage upper shoulder 266 of inner bore 264 of bridge member 232. Bridge member 232 may be secured to hanging member 200 through a threaded connection. In one embodiment, a set screw or pin member may engage both bridge member 232 and hanging member 200 to prevent unintentional disconnection between the two components.

Retaining sleeve 234 may include upper end 272 threadedly connected within inner bore 264 of bridge member 232 such that upper end surface 273 engages lower shoulder 268. Retaining sleeve 234 may also include upper shoulder 274, lower shoulder 276, lower end 278, and inner bore 280 extending from upper end 272 to lower end 278. Inner bore 280 of retaining sleeve 234 may include inner shoulder 282 near lower end 278. Lower end 278 may include one or more apertures each dimensioned to receive a pin member 284.

Housing 236 may include inner bore 288 and outer surface 290 each extending from upper end 292 to lower end 294. Inner bore 288 may include shoulder 296 near upper end 292. Outer surface 290 may include first shoulder 298 and second shoulder 300 both near lower end 294 of housing 236. Retaining sleeve 234 may be threadedly connected within inner bore 288 of housing 236 such that lower shoulder 276 of retaining sleeve 234 engages shoulder 296 of inner bore 288. Upper end 292 of housing 236 may engage lower end 262 of bridge member 232. Housing 236 may further include wiper blades 301 secured around outer surface 290 such that the lowest positioned wiper blade 301 engages first shoulder 298. Wiper retaining member 302 may be disposed around outer surface 290 of housing 236 above the highest positioned wiper blade 301 in order to secure wiper blades 301 onto housing 236. Wiper retaining member 302 may be threadedly connected to outer surface 290 of housing 236.

Seat housing 238 may include inner bore 304 and outer surface 306 each extending from upper end 308 to lower end 310. Upper end 308 of seat housing 238 may be threadedly connected around lower end 294 of housing 236. Upper end 308 of seat housing 238 may engage second shoulder 300 of outer surface 290 of housing 236.

End member 240 may include inner bore 314 with tapered shoulder 316 and groove 318, which may have a larger diameter than the surrounding surface of inner bore 314. End member 240 may also include tapered end surface 320. Outer surface 322 of end member 240 may include shoulder 324. End member 240 may be threadedly connected to inner bore 304 of seat housing 238 such that lower end 310 of seat housing 238 engages shoulder 324 of end member 240.

A shifting sleeve of middle segment 16 may include inner sleeve 330, spring frame 332, seat sleeve 334, guide 336, and segmented seat 338. These components may be housed within the inner bores of hanging member 200, bridge member 232, retaining sleeve 234, housing 236, and seat housing 238. Segmented seat 338 is one embodiment of a seat assembly.

Inner sleeve 330 may include inner bore 340 and outer surface 342. Outer surface 342 may include upper restricted diameter surface 344. Inner sleeve 330 may be slidingly disposed within inner bore 212 of hanging member 200, inner bore 264 of bridge member 232, inner bore 280 of retaining sleeve 234, and inner bore 288 of housing 236. In the engaged position of middle segment 16 shown in FIGS. 1 and 2A-2C, outer surface 342 of inner sleeve 330 may engage retainers 216, thereby maintaining retainers 216 in engagement with inner bore 114 of end member 40.

Spring frame 332 may be slidingly disposed within inner bore 288 of housing 236. Spring frame 332 may include upper portion 346, lower portion 348, and inner bore 350 extending through upper and lower portions 346 and 348. Spring frame 332 may also include shoulder 352 between upper portion 346 and lower portion 348. An outer surface of upper portion 346 may include upper shoulder 354, middle shoulder 356, and lower shoulder 358. Upper portion 346 of spring frame 332 may be selectively attached to retaining sleeve 234 such that an upper surface of spring frame 332 engages lower shoulder 282 of inner bore 280 of retaining sleeve 234. In one embodiment, pin members 284 may be disposed through apertures in lower end 278 of retaining sleeve 234, and may engage one or more bores in upper portion 346 of spring frame 332. In this way, pin members 284 may secure spring frame 332 to retaining sleeve 234. Upper portion 346 of spring frame 332 may also be threadedly attached to inner sleeve 330 such that a lower end of inner sleeve 330 is disposed within an upper end of inner bore 350 of spring frame 332. Inner bore 350 of spring frame 332 may include grooves 360 dimensioned to receive seal members 362 to fluidly seal the connection between spring frame 332 and inner sleeve 330. Seal members 362 may be formed of any device capable of providing a fluid seal between two components, such as an O-ring or other elastomeric seal.

Seat sleeve 334 may be slidingly disposed within inner bore 288 of housing 236 and inner bore 304 of seat housing 238. Seat sleeve 334 may include upper portion 364 having a generally tubular shape, lower portion 366 having an expanded outer surface relative to upper portion 364, and outer shoulder 368 between upper portion 364 and lower portion 366. Inner bore 370 of seat sleeve 334 may extend through upper portion 364 and lower portion 366. Inner bore 370 may include first inner shoulder 372 and second inner shoulder 374 in upper portion 364 of seat sleeve 334. Inner bore 370 may include cavity 376 in lower portion 366 of seat sleeve 334. Cavity 376 may have a larger inner diameter than inner bore 370 extending through upper portion 364 of seat sleeve 334. Cavity 376 may include tapered lower surface 378.

Seat sleeve 334 may be threadedly attached to spring frame 332 such that upper portion 364 of seat sleeve 334 is disposed around spring frame 332. In this position, an upper surface of seat sleeve 334 may engage middle shoulder 356 of upper portion 346 of spring frame 332, first inner shoulder 372 of seat sleeve 334 may engage lower shoulder 358 of upper portion 346 of spring frame 332, and second inner shoulder 374 of seat sleeve 334 may engage shoulder 352 of spring frame 332. In this position, upper portion 364 of seat sleeve 334 may be disposed within inner bore 288 of housing 236 and lower portion 366 of seat sleeve 334 may be disposed within inner bore 304 of seat housing 238 such that shoulder 368 of seat sleeve 334 engages a lower surface of housing 236.

Guide 336 may include inner bore 380 having upper portion 382 and lower portion 384 connected by shoulder 386. Guide 336 may be slidingly disposed within inner bore 370 of seat sleeve 334. The lower end of spring frame 332 may be disposed within upper portion 382 of inner bore 380. In this position, a lower surface of spring frame 332 engages shoulder 386 of guide 336.

Spring 390 may be disposed around lower portion 348 of spring frame 332 and within inner bore 370 of seat sleeve 334. An upper end of spring 390 may engage shoulder 352 of spring frame 332, and a lower end of spring 390 may engage an upper surface of guide 336. In this way, spring 390 may bias guide 336 in a downward direction.

Segmented seat 338 may be disposed within cavity 376 of seat sleeve 334. Segmented seat 338 may include two or more segments each having tapered outer surface 394 configured for cooperation with tapered lower surface 378 of cavity 376. Each segment of segmented seat 338 may also include tapered inner surface 396. In the retracted position of segmented seat 338 shown in FIGS. 1 and 2D, the segments of segmented seat 338 are separated by a distance or a space, and an inner diameter of segmented seat 338 may be greater than or equal to a diameter of inner bore 340 of inner sleeve 330. An upper surface of each segmented seat 338 may engage a lower surface of guide 336 such that spring 390 biases guide 336 and each segment of segmented seat 338 in the downward direction toward a deployed position of segmented seat 138 (shown in FIG. 5). In the deployed position, the segments of segmented seat 338 are in contact with one another, and the inner diameter of segmented seat 338 may be less than a diameter of inner bore 340 of inner sleeve 330. In this way, segmented seat 338 provides a selective seat of middle segment 16 of shifting sleeve device 10.

Figure 2D:
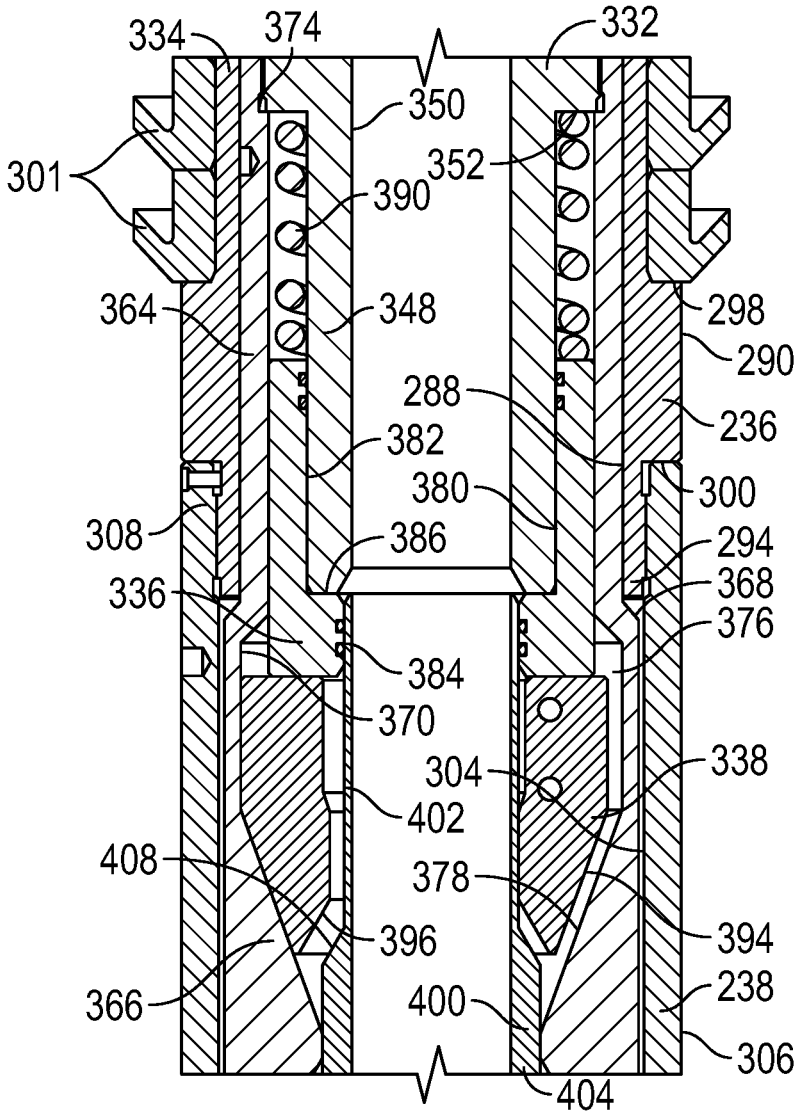
Figure 2E:
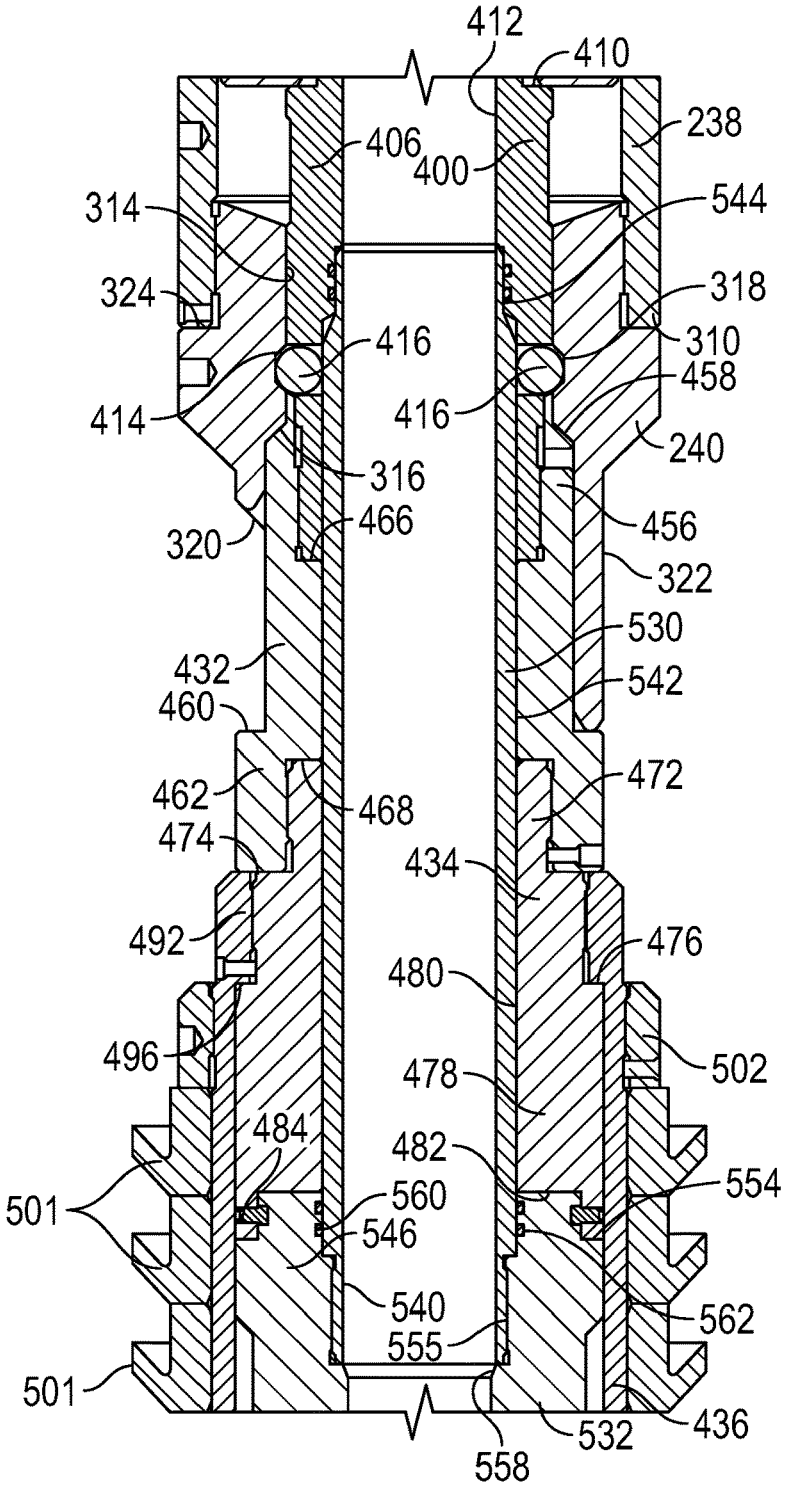
Figure 2F:
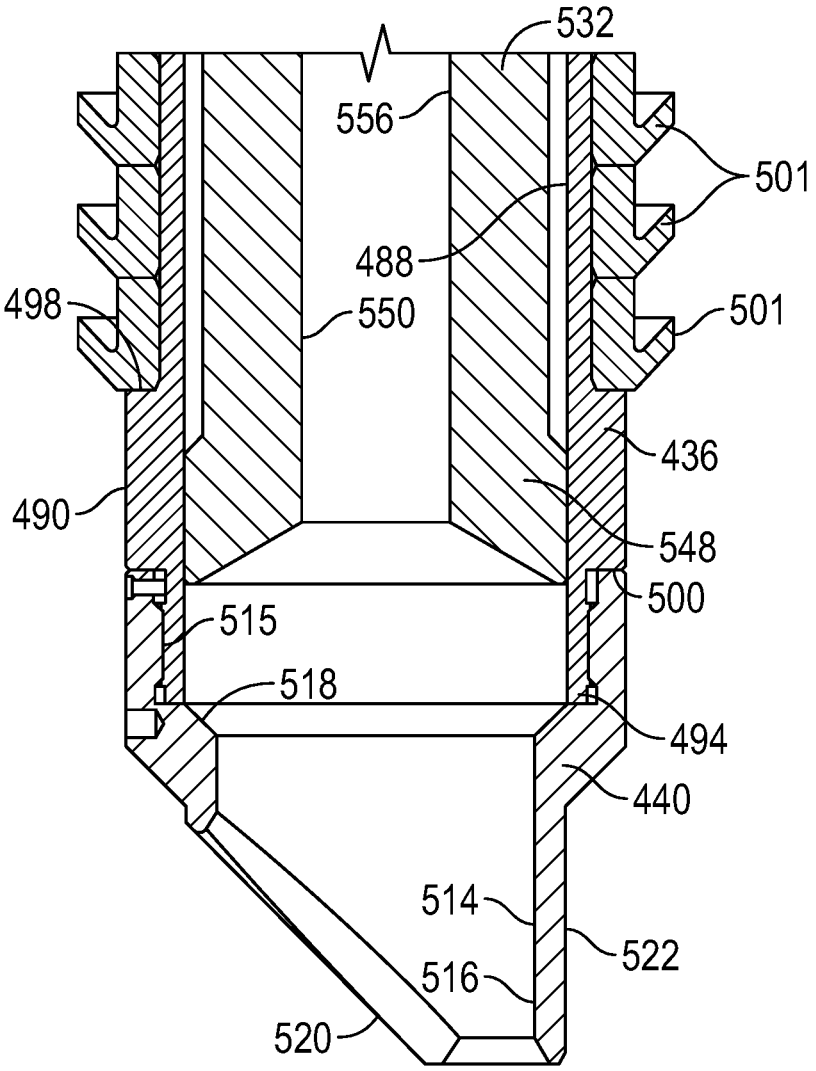

With reference now to FIGS. 1 and 2D-2E, lower segment 18 may include hanging member 400, which may have upper portion 402, middle portion 404, and lower portion 406. Tapered shoulder 408 may interconnect the outer surface of upper portion 402 and the outer surface of middle portion 404. Shoulder 410 may interconnect the outer surface of middle portion 404 and the outer surface of lower portion 406. Hanging member 400 may also include inner bore 412 extending through upper portion 402, middle portion 404, and lower portion 406.

In the position shown in FIGS. 1 and 2A-2E, hanging member 400 may be disposed within middle segment 16 to maintain the separation of the segments of segmented seat 338. Specifically, upper portion 402 of hanging member 400 may be disposed through lower portion 384 of inner bore 380 of guide 336 and through a central space between the segments of segmented seat 338. Tapered shoulder 408 of hanging member 400 may engage tapered inner shoulder 396 of each segment of segmented seat 338. In this position, middle portion 404 of hanging member 400 may be disposed through inner bore 370 of seat sleeve 334 with shoulder 410 of hanging member 400 engaging a lower surface of seat sleeve 334. Lower portion 406 of hanging member 400 may be disposed through inner bore 314 of end member 240. In this way, hanging member 400 of lower segment 18 maintains the separation of the segments of segmented seat 338 in the position shown in FIGS. 1 and 2A-2E.

Lower portion 406 of hanging member 400 may include one or more recesses 414 configured to house retainers 416. Each retainer 416 may engage inner bore 314 of end member 240 of middle segment 16 to connect hanging member 400 within inner bore 314 of end member 240 in the run-in position shown in FIGS. 1 and 2A-2E. In this way, lower segment 18 is retained in an engaged position with middle segment 16. Device 10 may include any number of recesses 414 and retainers 416. For example, device 10 may include between one and twenty recesses 414 and between one and twenty retainers 416. In one embodiment, retainers 416 may be formed of spherical elements designed to engage groove 318 in inner bore 314 of end member 240 to retain hanging member 400 within inner bore 314 of end member 240. In other embodiments, retainers 416 may be formed of rectangular dogs with tapered edges or a collet with multiple fingers.

As explained below, the release of hanging member 400 of lower segment 18 from the central space between segmented seat 338 causes guide 336 and the segments of segmented seat 338 to move in a downward direction due to the biasing force provided by spring 390. Because of the cooperation between tapered outer surfaces 394 of each segment of segmented seat 338 and tapered lower surface 378 of seat sleeve 334, the segments of segmented seat 338 move toward one another as the segments move in the downward direction to form a restricted diameter seat.

With reference to FIGS. 1 and 2D-2F, lower segment 18 may also include bridge member 432, retaining sleeve 434, housing 436, and end member 440. Bridge member 432 may include upper end 456 attached to lower portion 406 of hanging member 400. Bridge member 432 may also include tapered shoulder 458, shoulder 460, lower end 462, and inner bore 464 extending from upper end 456 to lower end 462. Upper end 456 of bridge member 432 may be connected within inner bore 314 of end member 240 such that tapered shoulder 458 of bridge member 432 engages tapered shoulder 316 of end member 240. A portion of tapered end surface 320 of end member 240 may engage shoulder 460 of bridge member 432. Inner bore 464 may include upper shoulder 466 and lower shoulder 468. Lower portion 406 of hanging member 400 may engage upper shoulder 466 of inner bore 464 of bridge member 432. Bridge member 432 may be secured to hanging member 400 through a threaded connection. In one embodiment, a set screw or pin member may engage both bridge member 432 and hanging member 400 to prevent unintentional disconnection between the two components.

Retaining sleeve 434 may include upper end 472 threadedly connected within inner bore 464 of bridge member 432 such that upper end surface 473 engages lower shoulder 468. Retaining sleeve 434 may also include upper shoulder 474, lower shoulder 476, lower end 478, and inner bore 480 extending from upper end 472 to lower end 478. Inner bore 480 of retaining sleeve 434 may include inner shoulder 482 near lower end 478. Lower end 478 may include one or more apertures each dimensioned to receive a pin member 484.

Housing 436 may include inner bore 488 and outer surface 490 each extending from upper end 492 to lower end 494. Inner bore 488 may include shoulder 496 near upper end 492. Outer surface 490 may include first shoulder 498 and second shoulder 500 both near lower end 494 of housing 436. Retaining sleeve 434 may be threadedly connected within inner bore 488 of housing 436 such that lower shoulder 476 of retaining sleeve 434 engages shoulder 496 of inner bore 488. Upper end 492 of housing 436 may engage lower end 462 of bridge member 432. Housing 436 may further include wiper blades 501 secured around outer surface 490 such that the lowest positioned wiper blade 501 engages first shoulder 498. Wiper retaining member 502 may be disposed around outer surface 490 of housing 436 above the highest positioned wiper blade 501 in order to secure wiper blades 501 onto housing 436. Wiper retaining member 502 may be threadedly connected to outer surface 490 of housing 436.

End member 440 may include inner bore 514 with upper portion 515 and lower portion 516 interconnected by shoulder 518. Upper portion 515 of inner bore 514 may have a larger diameter than lower portion 516. End member 440 may also include tapered end surface 520 and outer surface 522. End member 440 may be threadedly connected to housing 436 such that lower end 494 of housing 436 is disposed within upper portion 515 of inner bore 514 of end member 440. In one embodiment, lower end 494 of housing 436 may engage shoulder 518.

A shifting sleeve of lower segment 18 may include inner sleeve 530 and seat member 532. These components may be housed within the inner bores of hanging member 400, bridge member 432, retaining sleeve 434, and housing 436.

Inner sleeve 530 may include inner bore 540 and outer surface 542. Outer surface 542 may include upper restricted diameter surface 544. Inner sleeve 530 may be slidingly disposed within inner bore 412 of hanging member 400, inner bore 464 of bridge member 432, inner bore 480 of retaining sleeve 434, and inner bore 488 of housing 436. In the engaged position of lower segment 18 shown in FIGS. 1 and 2A-2F, outer surface 542 of inner sleeve 530 may engage retainers 416, thereby maintaining retainers 416 in engagement with inner bore 314 of end member 240.

Seat member 532 may be slidingly disposed within inner bore 488 of housing 436. Seat member 532 may include upper end 546, lower end 548, and inner bore 550 extending from upper end 546 to lower end 548. An outer surface of upper end 546 may include upper shoulder 554. Upper end 546 of seat member 532 may be selectively attached to retaining sleeve 434 such that an upper surface of seat member 532 engages lower shoulder 482 of inner bore 480 of retaining sleeve 434. In one embodiment, pin members 484 may be disposed through apertures in lower end 478 of retaining sleeve 434, and may engage one or more bores in upper end 546 of seat member 532. In this way, pin members 484 may secure seat member 532 to retaining sleeve 434. Inner bore 550 of seat member 532 may include upper portion 555 and lower portion 556 interconnected by shoulder 558. Shoulder 558 may also be referred to as seat 558 or seat surface 558. Upper portion 555 may have a larger diameter than lower portion 556 of inner bore 550. Upper end 546 of seat member 532 may also be threadedly attached to inner sleeve 530 such that a lower end of inner sleeve 530 is disposed within an upper end of inner bore 550 of seat member 532. Inner bore 550 of seat member 532 may include grooves 560 dimensioned to receive seal members 562 to fluidly seal the connection between seat member 532 and inner sleeve 530. Seal members 562 may be formed of any device capable of providing a fluid seal between two components, such as an O-ring or other elastomeric seal. In one alternate embodiment, seat member 532 may include a sealed seat surface 558 such that inner bore 550 of seat member 532 extends only from upper end 546 to seat surface 558.

Figure 3:
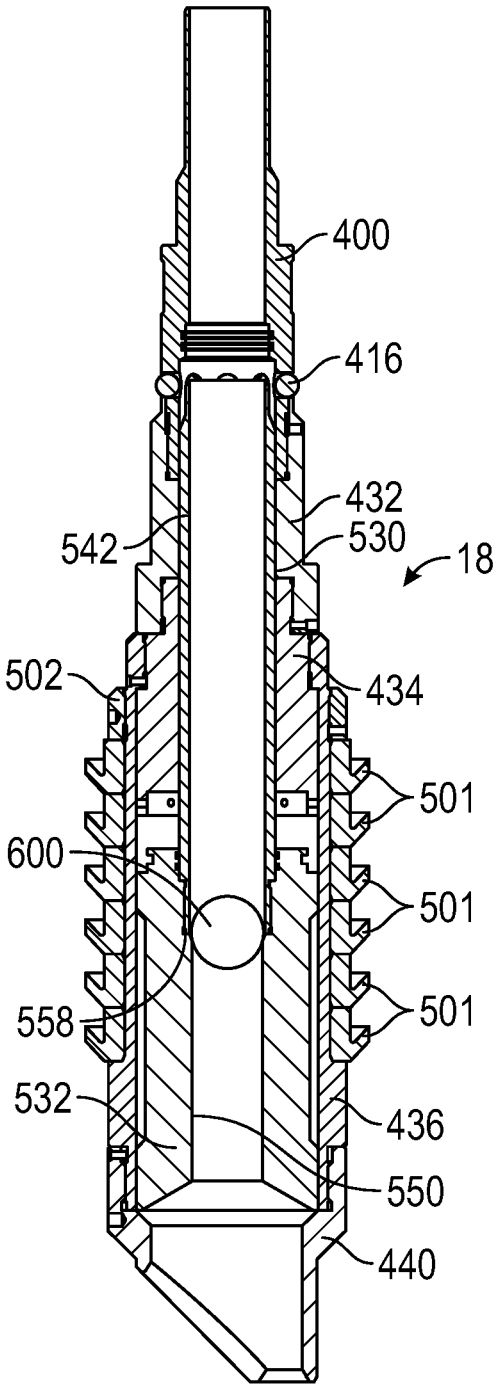
FIG. 3 is a sectional view of the lower segment in a released position and disconnected from a remainder of the shifting sleeve device.

Referring now to FIGS. 1, 2A-2F, and 9, shifting sleeve device 10 may be lowered into wellbore 566 with upper segment 14, middle segment 16, and lower segment 18 each in the engaged position. For example, upper suspension sleeve 12 may be attached to a lower end of tubular string 568. When lower segment 18 reaches a desired location within wellbore 566, plug 600 (shown in FIG. 3) may be dropped into the central bore of tubular string 568 and through the central bore running through shifting sleeve device 10. Plug 600 may pass through the central bore of all components of upper segment 14 and middle segment 16, but plug 600 may engage and be stopped by seat 558 within lower segment 18 as shown in FIG. 3. Plug 600 may be any object capable of sealing inner bore 550 of seat member 532 by engaging seat 558. For example, plug 600 may be formed of a spherical member. Alternatively, plug 600 may be formed of a dart or a tapered bottom bar. In another alternate embodiment, plug 600 may be formed of a dissolving plug such that inner bore 550 of seat member 532 is sealed temporarily until plug 600 dissolves.

Pumping a fluid into the central bore of tubular string 568 and through the central bore of shifting sleeve device 10 above plug 600 may shear pin members 484, thereby allowing seat member 532 along with inner sleeve 530 to move in a downward direction within the inner bores of hanging member 400, bridge member 432, retaining sleeve 434, and housing 436 from a first position (shown in FIG. 1) into a second position (shown in FIG. 3). With inner sleeve 530 in the second position, outer surface 542 of inner sleeve 530 may no longer maintain retainers 416 in engagement with groove 318 of end member 240 of middle segment 16. For example, restricted diameter surface 544 of inner sleeve 530 may be positioned in line with retainers 416 after inner sleeve 530 and seat member 532 are transferred into the second position shown in FIG. 3. In this way, lower segment 18 may be released from middle segment 16 and the remainder of shifting sleeve device 10. Retainers 416 may be retained, however, within recesses 414 of hanging member 400.

In one alternate embodiment, seat member 532 may include a sealed seat surface 558 such that inner bore 550 of seat member 532 extends only from upper end 546 to seat surface 558. In this embodiment, plug 600 is not necessary for transferring inner sleeve 530 and seat member 532 into the second position. Instead, pumping a fluid into the central bore of tubular string 568 and through the central bore of shifting sleeve device 10 above sealed seat surface 558 may shear pin members 484, thereby allowing seat member 532 to move into the second position.

After lower segment 18 is released from shifting sleeve device 10, wiper blades 501 may be used to wipe an inner surface of casing 601 within wellbore 566 in order to clean off cement. Alternatively, wiper blades 501 of lower segment 18 may be used to ensure complete displacement of a fluid within wellbore 566, such as a cement, an acid, or a solvent (i.e., spotting the fluid). In this embodiment, lower segment 18 keeps all of the fluid together to prevent the fluid from stringing out over a long distance. In other words, lower segment 18 controls the location of the fluid pill.

Figure 4:
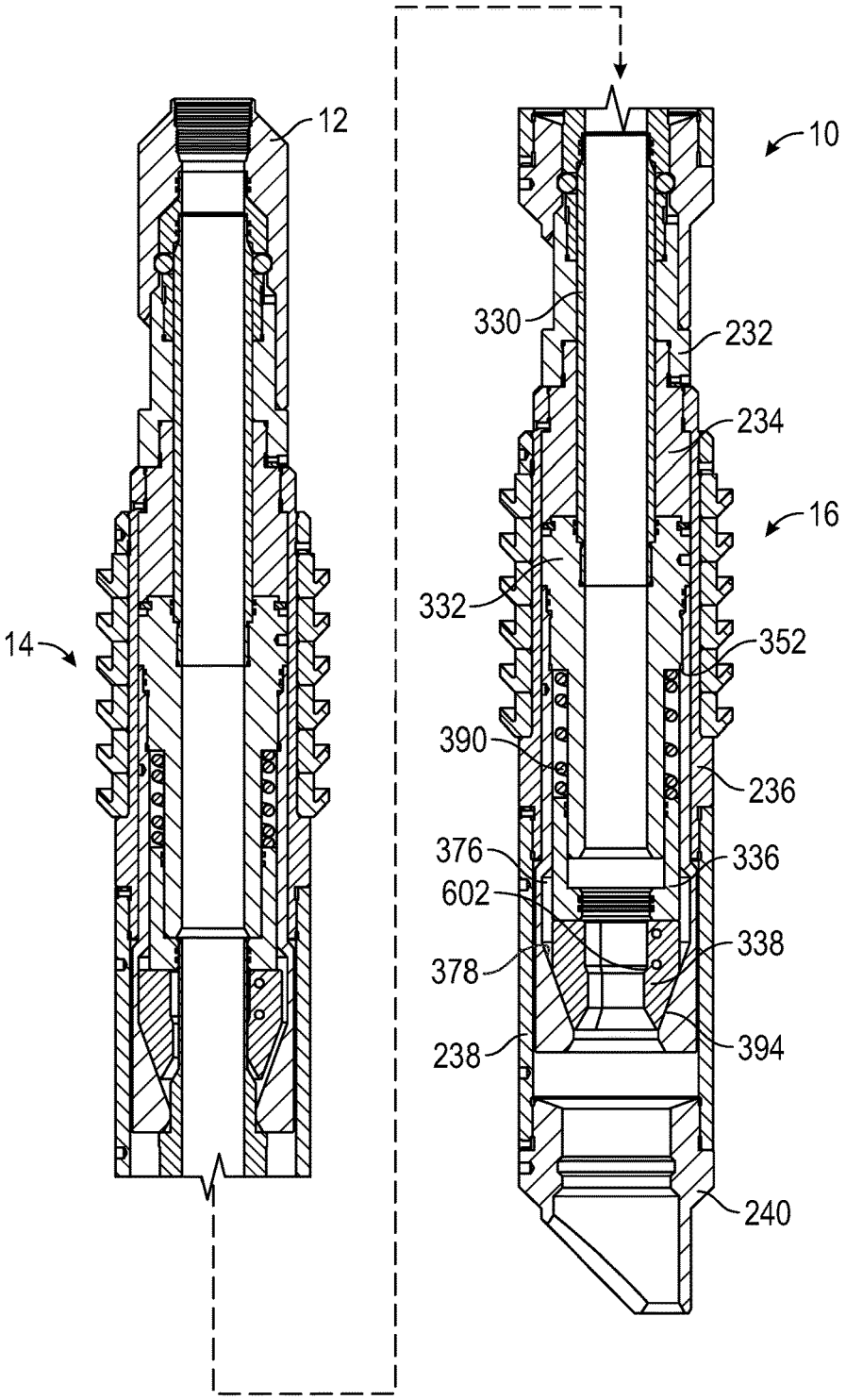
FIG. 4 is a sectional view of the shifting sleeve device after release of the lower segment, with the upper segment and middle segment each in the engaged position, the segmented seat of the upper segment in the retracted position, and the segmented seat of the middle segment in a deployed position.
Figure 10:
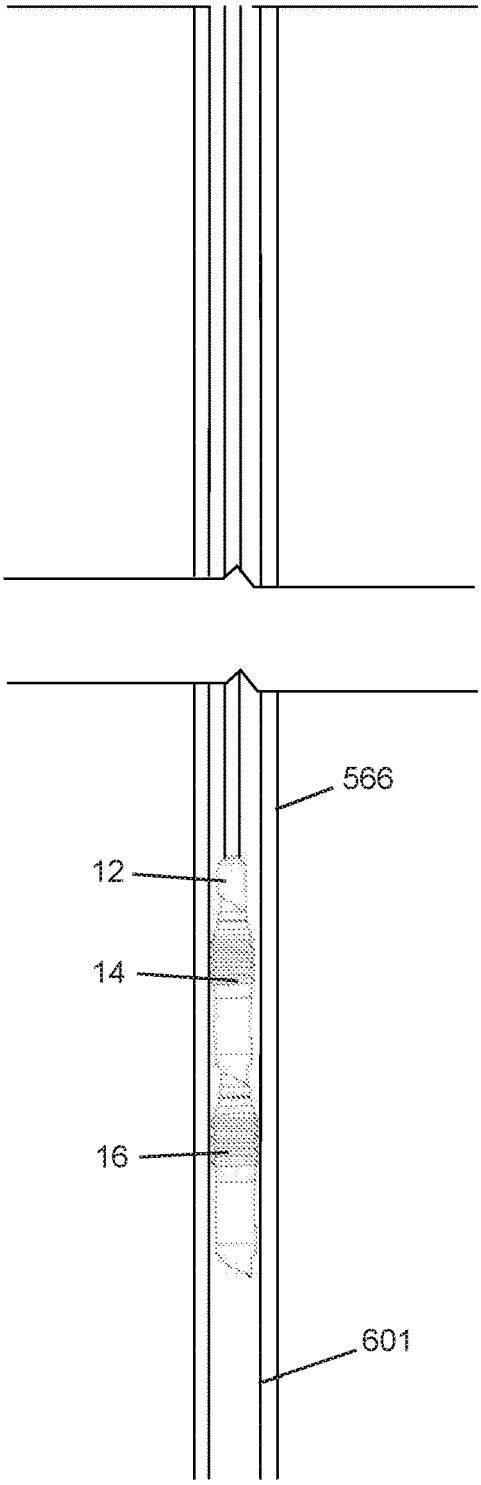
FIG. 10 is a schematic view of the shifting sleeve device positioned within a wellbore after release of the lower segment.

FIGS. 4 and 10 illustrate shifting sleeve device 10 after lower segment 18 is released. When hanging member 400 is released from middle segment 16, segmented seat 338 may be urged from the retracted position (shown in FIG. 1) into the deployed position (shown in FIG. 4) by spring 390 and guide 336. In other words, the segments of segmented seat 338 are no longer held apart by hanging member 400 and are biased downward by spring 390 and guide 336. Specifically, spring 390 and guide 336 may push the segments downward such that tapered outer surface 394 of segmented seat 338 slides along tapered lower surface 378 within cavity 376 of seat sleeve 334. The interaction of tapered outer surface 394 of segmented seat 338 and tapered lower surface 378 of seat sleeve 334 urges the segments of segmented seat 338 toward one another to form seat surface 602 of middle segment 16. Seat surface 602 may form a reduced inner diameter area within the central bore through middle segment 16. For example, the inner diameter of seat surface 602 may be less than inner diameter 340 of inner sleeve 330. In one embodiment, the inner diameter of seat surface 602 may be approximately equal to the diameter of inner bore 550 of seat member 532 of lower segment 18.

Figure 5:
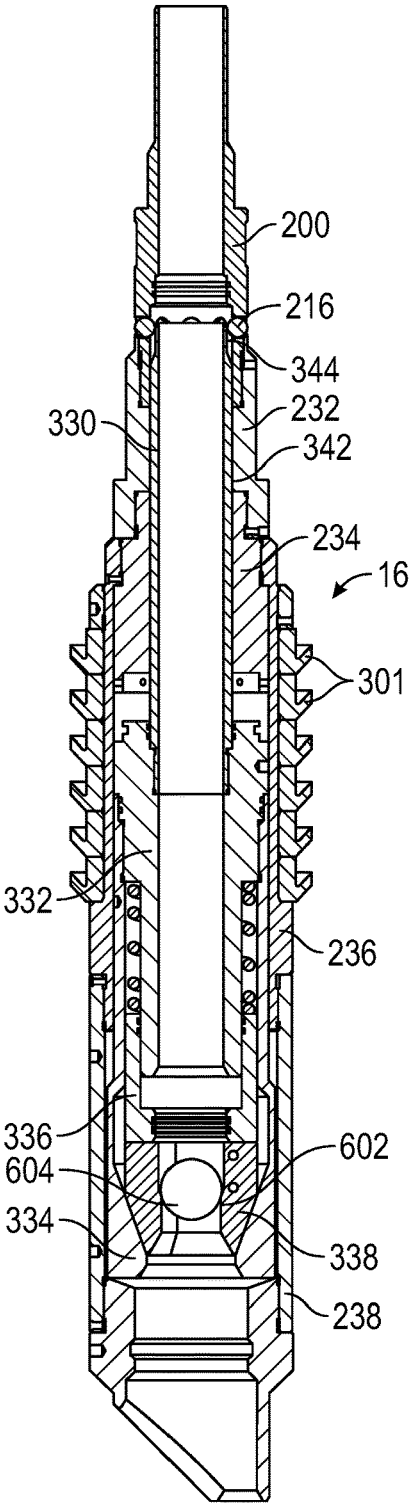
FIG. 5 is a sectional view of the middle segment in a released position and disconnected from a remainder of the shifting sleeve device.

When middle segment 16 reaches a desired location within wellbore 566, plug 604 (shown in FIG. 5) may be dropped into the central bore of tubular string 568 and through the central bore running through shifting sleeve device 10. Plug 604 may pass through the central bore of all components of upper segment 14, but plug 604 may engage and be stopped by seat surface 602 within middle segment 16 as shown in FIG. 5. Plug 604 may be any object capable of sealing the inner bore of segmented seat 338 by engaging seat surface 602. For example, plug 604 may be formed of a spherical member. Alternatively, plug 604 may be formed of a dart or a tapered bottom bar. In another alternate embodiment, plug 604 may be formed of a dissolving plug such that the inner bore of segmented seat 338 is sealed temporarily until plug 604 dissolves.

Pumping a fluid into the central bore of tubular string 568 and through the central bore of shifting sleeve device 10 above plug 604 may shear pin members 284, thereby allowing segmented seat 338, seat sleeve 334, spring frame 332, and inner sleeve 330 to move in a downward direction within the inner bores of hanging member 200, bridge member 232, retaining sleeve 234, housing 236, and seat housing 238 from a first position (shown in FIG. 4) into a second position (shown in FIG. 5). With inner sleeve 330 in the second position, outer surface 342 of inner sleeve 330 may no longer maintain retainers 216 in engagement with groove 118 of end member 40 of upper segment 14. For example, restricted diameter surface 344 of inner sleeve 330 may be positioned in line with retainers 216 after inner sleeve 330 and spring frame 332 are transferred into the second position shown in FIG. 5. In this way, middle segment 16 may be released from upper segment 14 and the remainder of shifting sleeve device 10. Retainers 216 may be retained, however, within recesses 214 of hanging member 200.

After middle segment 16 is released from shifting sleeve device 10, wiper blades 301 may be used to wipe an inner surface of casing 601 within wellbore 566 in order to clean off cement. Alternatively, wiper blades 301 of middle segment 16 may be used to control the location of a fluid within wellbore 566 as described above in connection with wiper blades 501 of lower segment 18.

Figure 6:
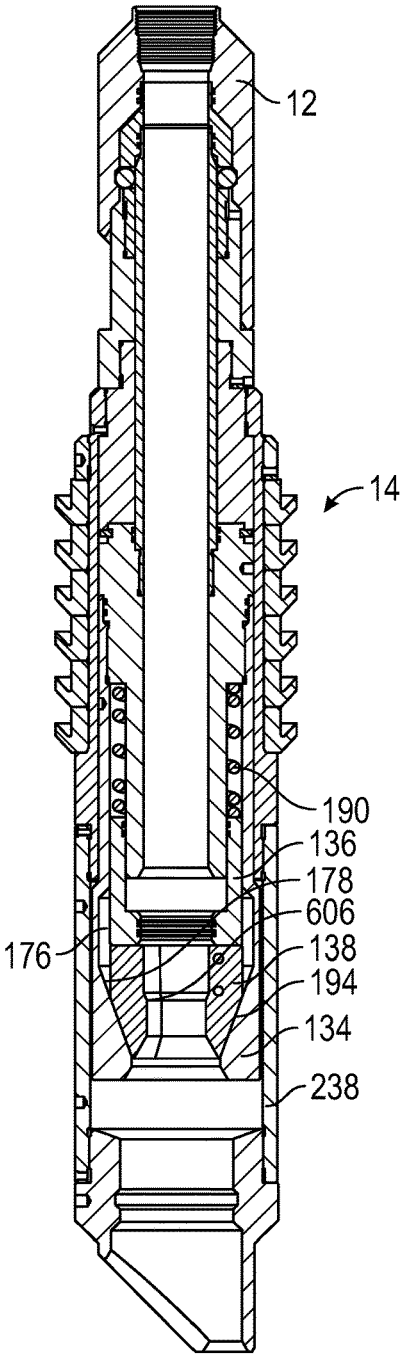
FIG. 6 is a sectional view of the shifting sleeve device after release of the middle segment, with the upper segment in the engaged position and the segmented seat of the upper segment in a deployed position.
Figure 11:
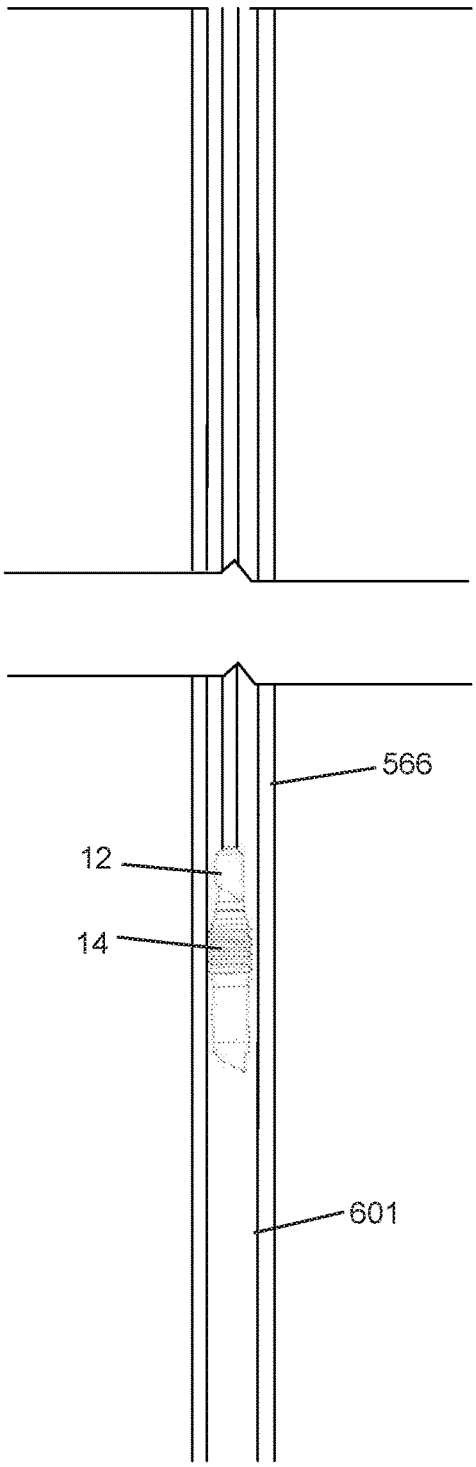
FIG. 11 is a schematic view of the shifting sleeve device positioned within a wellbore after release of the middle segment.

FIGS. 6 and 11 illustrate shifting sleeve device 10 after middle segment 16 is released. When hanging member 200 is released from upper segment 14, segmented seat 138 may be urged from the retracted position (shown in FIG. 1) into the deployed position (shown in FIG. 6) by spring 190 and guide 136. In other words, the segments of segmented seat 138 are no longer held apart by hanging member 200 and are biased downward by spring 190 and guide 136. Specifically, spring 190 and guide 136 may push the segments downward such that tapered outer surface 194 of segmented seat 138 slides along tapered lower surface 178 within cavity 176 of seat sleeve 134. The interaction of tapered outer surface 194 of segmented seat 138 and tapered lower surface 178 of seat sleeve 134 urges the segments of segmented seat 138 toward one another to form seat surface 606 of upper segment 14. Seat surface 606 may form a reduced inner diameter area within the central bore through upper segment 14. For example, the inner diameter of seat surface 606 may be less than inner diameter 140 of inner sleeve 130. In one embodiment, the inner diameter of seat surface 606 may be approximately equal to the inner diameter of seat surface 602 of middle segment 16 and approximately equal to the diameter of inner bore 550 of seat member 532 of lower segment 18. In this way, shifting sleeve device 10 includes multiple seats of approximately equal size.

Figure 7:
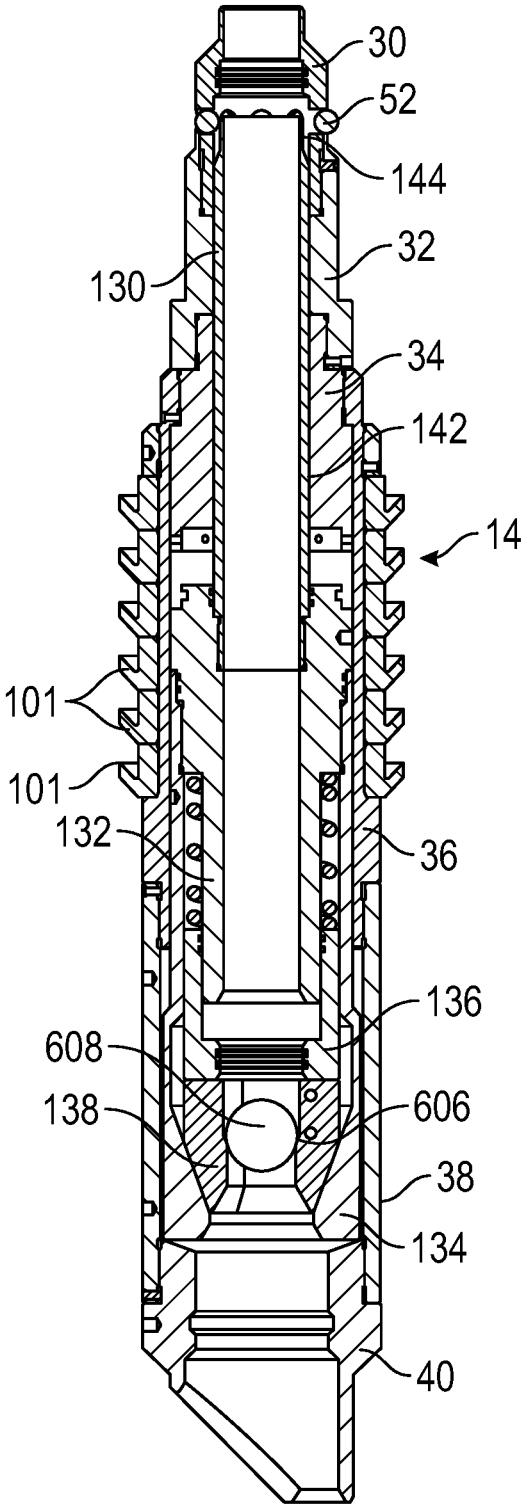
FIG. 7 is a sectional view of the upper segment in a released position and disconnected from a remainder of the shifting sleeve device.
Figure 8:
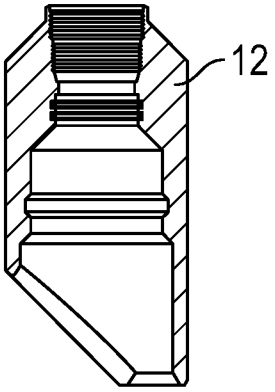
FIG. 8 is a sectional view of an upper suspension sleeve of the shifting sleeve device after release of the upper segment.
Figure 9:
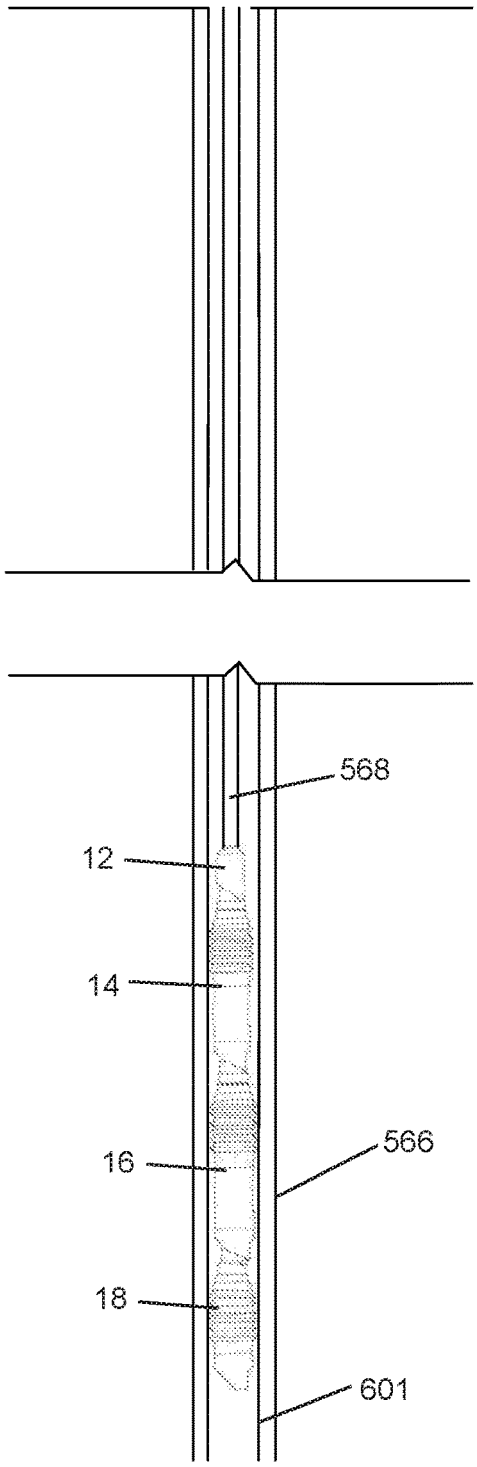
FIG. 9 is a schematic view of the shifting sleeve device positioned within a wellbore.

When upper segment 14 reaches a desired location within wellbore 566, plug 608 (shown in FIG. 7) may be dropped into the central bore of tubular string 568 and through the central bore running through shifting sleeve device 10. Plug 608 may engage and be stopped by seat surface 606 within upper segment 16 as shown in FIG. 7. Plug 608 may be any object capable of sealing the inner bore of segmented seat 138 by engaging seat surface 606. For example, plug 608 may be formed of a spherical member. Alternatively, plug 606 may be formed of a dart or a tapered bottom bar. In another alternate embodiment, plug 606 may be formed of a dissolving plug such that the inner bore of segmented seat 138 is sealed temporarily until plug 606 dissolves.

Pumping a fluid into the central bore of tubular string 568 and through the central bore of shifting sleeve device 10 above plug 608 may shear pin members 84, thereby allowing segmented seat 138, seat sleeve 134, spring frame 132, and inner sleeve 130 to move in a downward direction within the inner bores of hanging member 30, bridge member 32, retaining sleeve 34, housing 36, and seat housing 38 from a first position (shown in FIG. 6) into a second position (shown in FIG. 7). With inner sleeve 130 in the second position, outer surface 142 of inner sleeve 130 may no longer maintain retainers 52 with groove 23 of upper suspension sleeve 12. For example, restricted diameter surface 144 of inner sleeve 130 may be positioned in line with retainers 52 after inner sleeve 130 and spring frame 132 are transferred into the second position shown in FIG. 7. In this way, upper segment 16 may be released from upper suspension sleeve 12, which is the remainder of shifting sleeve device 10. Retainers 52 may be retained, however, within recesses 50 of hanging member 30.

After upper segment 14 is released from upper suspension sleeve 12, wiper blades 101 may be used to wipe an inner surface of casing 601 within wellbore 566 in order to clean off cement. Alternatively, wiper blades 101 of upper segment 14 may be used to control the location of a fluid within wellbore 566 as described above in connection with wiper blades 501 of lower segment 18.

Shifting sleeve device 10 provides a shifting sleeve device with multiple releasable segments without having the sequential reduction in diameter required by conventional shifting sleeve devices employed with plugs. Specifically, the inner diameter of the seat 558 of lower segment 18, segmented seat 338 of middle segment 16 in the deployed position (shown in FIG. 4), and segmented seat 138 of upper segment 14 in the deployed position (shown in FIG. 6) may be approximately equal such that each seat is engaged with a plug having approximately the same diameter. In other words, plugs 600, 604, and 608 may each have approximately equal diameters. Accordingly, use of shifting sleeve device 10 in a wellbore provides the ability to run tools through shifting sleeve device 10. Additionally, shifting sleeve device 10 may be activated to release lower segment 18, middle segment 16, or upper segment 14 without use of wireline, thereby saving operators the increased costs associated with wireline operations.

In an alternate embodiment, shifting sleeve device 10 includes only upper segment 14 and lower segment 18 without middle segment 16 such that hanging member 400 of lower segment 18 is connected within the central bore of upper segment 14.

In another alternate embodiment, shifting sleeve device 10 may include an upper segment and at least one lower segment including the sleeve and seat arrangements described above with functions other than wiper tools. For example, shifting sleeve device 10 may include one or more releasable segments having functions other than wiper tools.

Shifting sleeve device 10 may include any number of segments in sequence that the tool string is capable of supporting within the wellbore.

In yet another alternate embodiment, segmented seats 138, 338 and seat member 532 may include a profile specifically designed to receive a reciprocal plug. This embodiment may prevent unintentional actuation of spring frame 132, 332 and seat member 532, such as with a mass of mud or other debris engaging the seat.

Other embodiments of the shifting sleeve device include a seat assembly having a flapper ball seat. The flapper ball seat may pivot between a retracted position and a deployed position. In the retracted position, the seat assembly may have an inner diameter that is equal to or greater than a diameter of the inner bore of the shifting sleeve device. In the deployed position, the flapper ball seat may provide an inner diameter that is less than the diameter of the inner bore of the shifting sleeve device such that a seat surface is formed. This embodiment of the shifting sleeve device may include the same features and function in the same way as shifting sleeve device 10 except as otherwise noted.

Figure 12A:
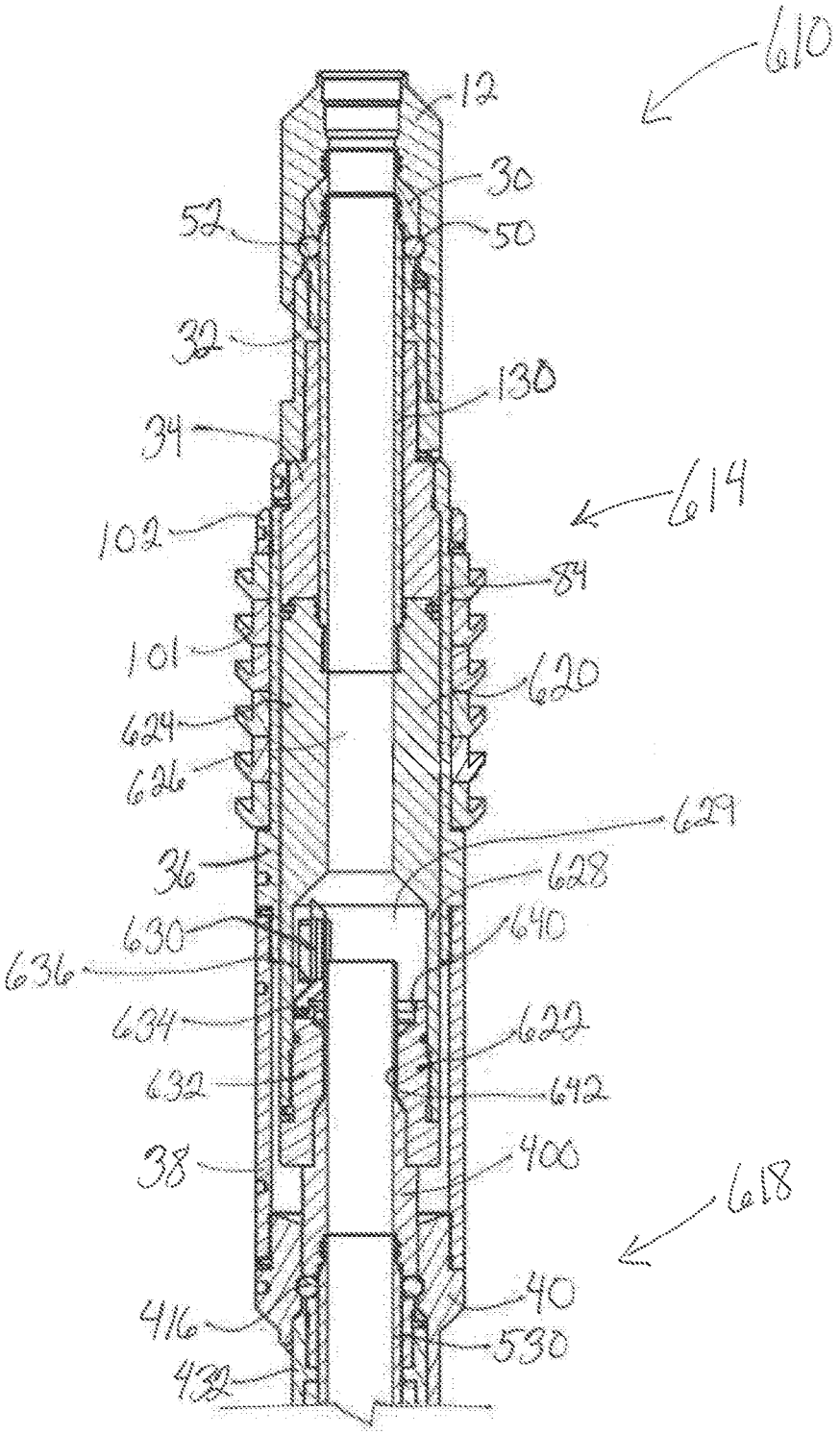
FIGS. 12A and 12B are sequential sectional views of an alternate shifting sleeve device including an upper segment and a lower segment each in an engaged position, and with a flapper ball seat of the upper segment in a retracted position.
Figure 12B:
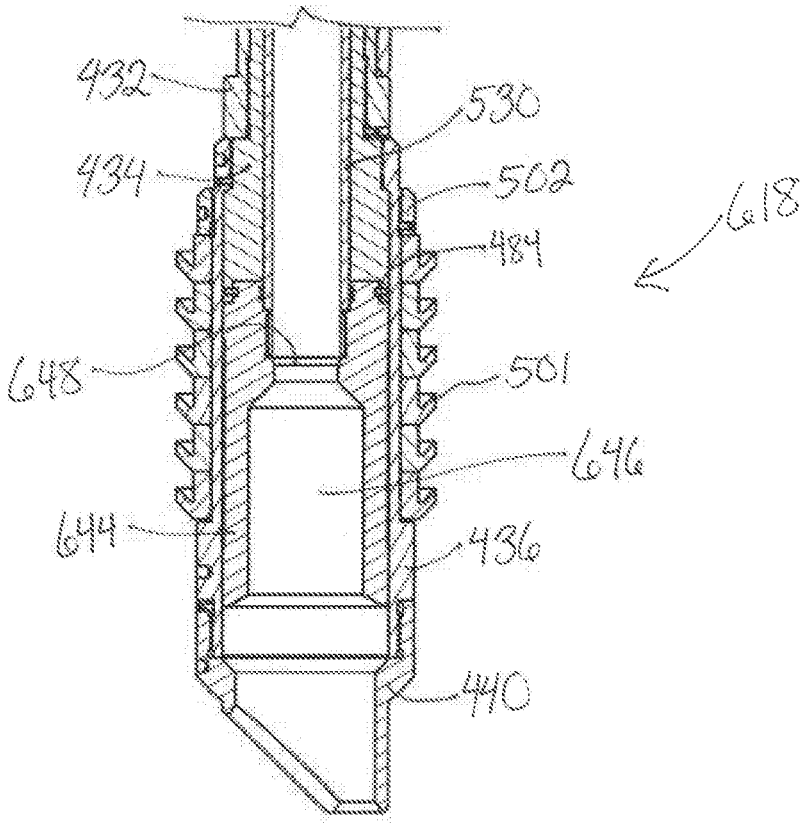

For example, FIGS. 12A and 12B illustrate alternate shifting sleeve device 610. Except as otherwise noted, alternate shifting sleeve device 610 includes the same components, features, and characteristics as described in connection with corresponding elements of shifting sleeve device 10 described above. Alternate shifting sleeve device 610 may include upper suspension sleeve 12, upper segment 614, and lower segment 618. Shifting sleeve device 610 may be configured to sequentially release lower segment 618, then upper segment 614 by dropping a triggering plug through the central bore running through each segment. The triggering plug may engage a ball seat of lower segment 618 to shift a sleeve of lower segment 618, thereby releasing lower segment 618 from upper segment 614. The release of lower segment 618 may allow a flapper ball seat of upper segment 614 to move from a retracted position (shown in FIGS. 12A and 12B) to a deployed position (shown in FIG. 14) to provide a ball seat of upper segment 614. A triggering plug may engage the flapper ball seat in the deployed position to shift a sleeve of upper segment 614, thereby releasing upper segment 614 from upper suspension sleeve 12.

Upper segment 614 may include hanging member 30, bridge member 32, retaining sleeve 34, housing 36, seat housing 38, and end member 40. Each retainer 52 held within one of recesses 50 of hanging member 30 may engage the inner bore of upper suspension sleeve 12 to connect hanging member 30 within the inner bore of upper suspension sleeve 12 in an engaged position of upper segment 614 shown in FIGS. 12A and 12B. The shifting sleeve of upper segment 614 may include inner sleeve 130, flapper frame 620, and flapper assembly 622. These components may be slidingly housed within the inner bores of hanging member 30, bridge member 32, retaining sleeve 34, housing 36, and seat housing 38. In the engaged position, inner sleeve 130 may engage retainers 52 to maintain the position of retainers 52 in engagement with the inner bore of upper suspension sleeve 12, thereby retaining upper segment 614 in the engaged position with upper suspension sleeve 12.

Flapper frame 620 may be slidingly disposed within the inner bore of housing 36 and housing 38. Flapper frame 620 may include upper portion 624 having inner bore 626, and lower portion 628 having inner cavity 629. Upper portion 624 may be selectively attached to retaining sleeve 34. In one embodiment, pin members 84 may engage apertures in the lower end of retaining sleeve 34 and one or more bores in upper portion 624 of flapper frame 620 to secure flapper frame 620 to retaining sleeve 34. Upper portion 624 of flapper frame 620 may also be threadedly attached to inner sleeve 130 such that a lower end of inner sleeve 130 is disposed within an upper end of inner bore 626 of flapper frame 620. Inner bore 626 of flapper frame 620 may include grooves dimensioned to receive seal members to fluidly seal the connection between flapper frame 620 and inner sleeve 130.

Flapper assembly 622 is one embodiment of a seat assembly. Flapper assembly 622 includes flapper ball seat 630 pivotally attached to flapper body 632. Flapper body 632 may be threadedly attached to lower portion 628 of flapper frame 620 such that flapper ball seat 630 is housed within inner cavity 629 of flapper frame 620. Flapper ball seat 630 may be configured to pivot about hinge 634. In the retracted position (shown in FIGS. 12A and 12B), flapper ball seat 630 may engage stopper 636 within inner cavity 629 of flapper frame 620. In a deployed position (shown in FIGS. 14 and 15), flapper ball seat 630 may engage shoulder 640 of flapper body 632 to provide a restricted diameter ball seat of upper segment 614. Flapper body 632 may include inner bore 642.

Referring still to FIGS. 12A and 12B, lower segment 618 may include hanging member 400, which is at least partially disposed within inner bore 642 of flapper body 632 of upper segment 614 in an engaged position of lower segment 618 with upper segment 614. One or more shoulders of hanging member 400 may engage reciprocal shoulders of inner bore 642 of flapper body 623. In this position, hanging member 400 retains flapper ball seat 630 in the retracted position. Each retainer 416 held within one of the recesses of hanging member 400 may engage the inner bore of end member 40 of upper segment 614 to connect hanging member 400 to upper segment 614 in the engaged position. Lower segment 618 may also include bridge member 432, retaining sleeve 434, housing 436, and end member 440. The shifting sleeve of lower segment 618 may include inner sleeve 530 and seat member 644. These components may be slidingly housed within the inner bores of hanging member 400, bridge member 432, retaining sleeve 434, and housing 436. In the engaged position, inner sleeve 530 may engage retainers 416 to maintain the position of retainers 416 in engagement with the inner bore of end member 40 of upper segment 614, thereby retaining lower segment 618 in the engaged position with upper segment 614.

Seat member 644 may be slidingly disposed within the inner bore of housing 436. Seat member 644 may include inner bore 646 having a restricted diameter shoulder to form seat surface 648. An upper end of seat member 644 may be threadedly attached to inner sleeve 530 such that a lower end of inner sleeve 530 is disposed within an upper end of inner bore 646 of seat member 644. Seat member 644 may also be selectively attached to retaining sleeve 434. In one embodiment, pin members 484 may engage apertures in the lower end of retaining sleeve 434 and one or more bores in the upper end of seat member 644 to secure seat member 644 to retaining sleeve 434. Inner bore 646 of seat member 644 may also include grooves dimensioned to receive seal members to fluidly seal the connection between seat member 644 and inner sleeve 530.

Figure 13:
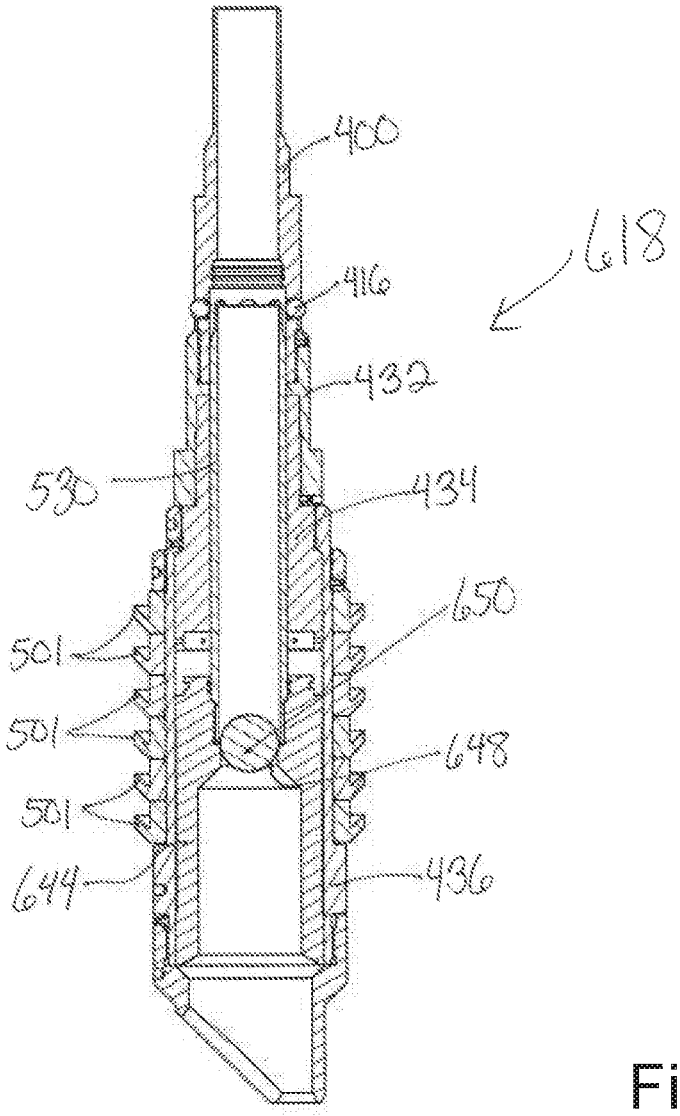
FIG. 13 is a sectional view of the lower segment of the alternate shifting sleeve device in the released position.

Referring again to FIGS. 12A and 12B, alternate shifting sleeve device 610 may be lowered into a wellbore with upper segment 614 and lower segment 618 each in the engaged position. For example, upper suspension sleeve 12 may be attached to a lower end of a tubular string. When lower segment 618 reaches a desired location within the wellbore, plug 650 (shown in FIG. 13) may be dropped into the central bore of the tubular string and through the central bore running through device 610. Plug 650 may engage and be stopped by seat surface 648 of the shifting sleeve of lower segment 618 as shown in FIG. 13. Plug 650 may be any object capable of sealing inner bore 646 of seat member 644 by engaging seat surface 648 as described in connection with plug 600 above.

Pumping a fluid into the central bore of the device above plug 650 may shear pin members 484, thereby allowing seat member 644 along with inner sleeve 530 to move in a downward direction within the inner bores of hanging member 400, bridge member 432, retaining sleeve 434, and housing 436 into a released position (shown in FIG. 13). This downward movement causes inner sleeve 530 to no longer maintain retainers 416 in engagement within groove 118 (shown in FIG. 14) of end member 40 of upper segment 614, which releases lower segment 618 from upper segment 614. Retainers 416 may be retained, however, within the recesses of hanging member 400. After lower segment 618 is released, wiper blades 501 may be used to wipe an inner surface of casing 601 within the wellbore as described above.

Figure 14:
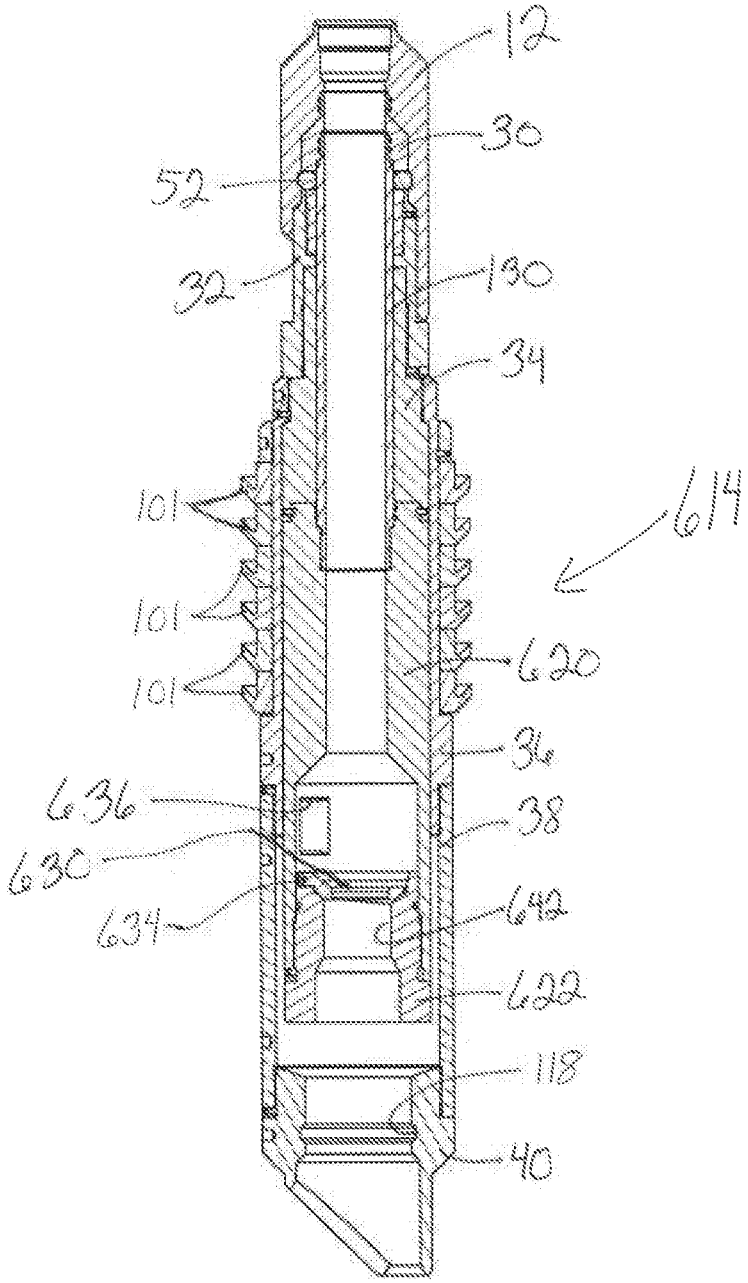
FIG. 14 is a sectional view of the alternate shifting sleeve device after release of the lower segment, with the upper segment in the engaged position and the flapper ball seat of the upper segment in the deployed position.

FIG. 14 illustrates alternate shifting sleeve device 610 after lower segment 618 is released. When hanging member 400 of lower segment 618 is released from upper segment 614, flapper ball seat 630 may pivot about hinge 634 from the retracted position (shown in FIG. 12A) to the deployed position to form a restricted diameter ball seat of the sliding sleeve of upper segment 614. When upper segment 614 reaches a desired location within the wellbore, plug 652 (shown in FIG. 15) may be dropped into the central bore of the tubular string and through the central bore running through device 610. Plug 652 may engage and be stopped by flapper ball seat 630. Plug 652 may be any object capable of sealing the inner bore of flapper assembly 622 by engaging flapper ball seat 630 as described above in connection with plug 604.

Figure 15:
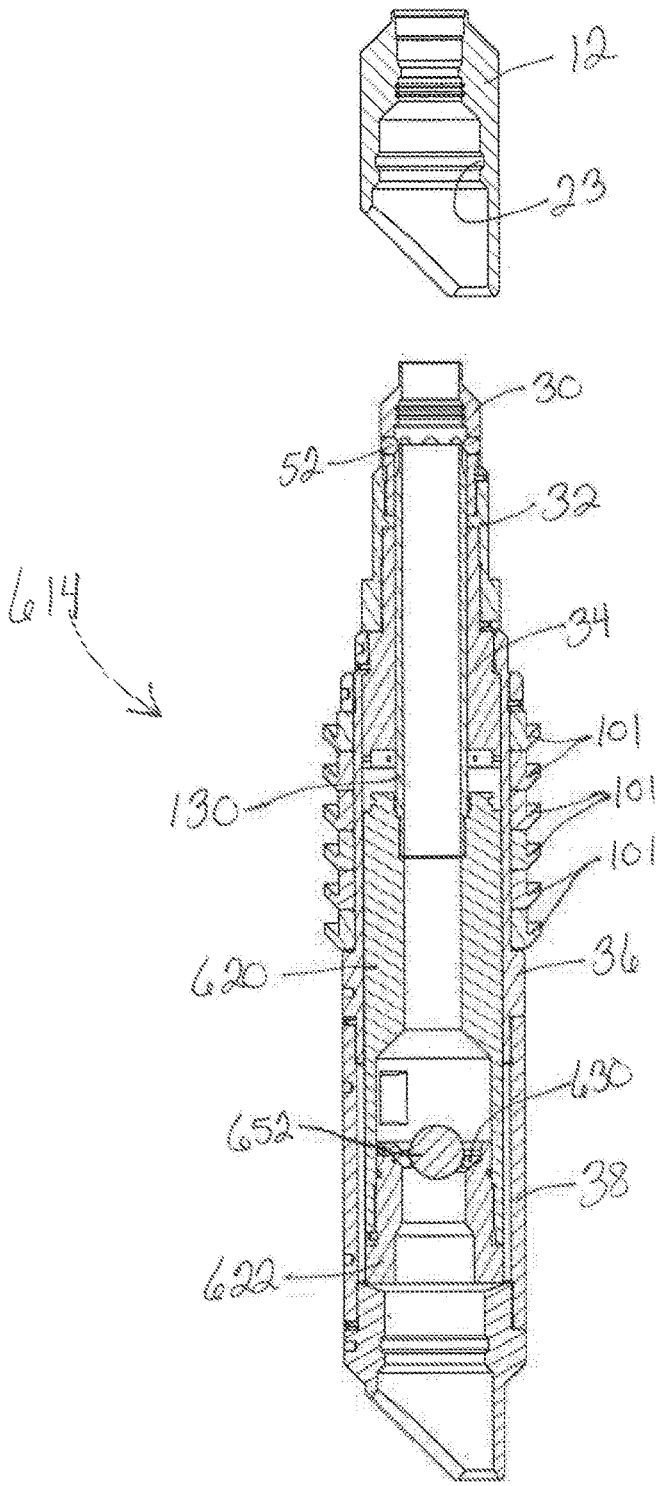
FIG. 15 is a sectional view of the upper segment and an upper suspension sleeve of the alternate shifting sleeve device after release of the upper segment.

Pumping a fluid into the central bore of the device above plug 652 may shear pin members 84, thereby allowing flapper assembly 622, flapper frame 620, and inner sleeve 130 to move in a downward direction within the inner bores of hanging member 30, bridge member 32, retaining sleeve 34, housing 36, and seat housing 38 into a released position (shown in FIG. 15). This downward movement causes inner sleeve 130 to no longer maintain retainers 52 in engagement within groove 23 (shown in FIG. 15) of upper suspension sleeve 12, which releases upper segment 614 from upper suspension sleeve 12. Retainers 52 may be retained, however, within the recesses of hanging member 30. After upper segment 614 is released, wiper blades 101 may be used to wipe an inner surface of casing 601 within the wellbore as described above.

In still other embodiments, the shifting sleeve device includes fluid ports that are opened, closed, or restricted when each sleeve is displaced from the first position to the second position. In other words, the secondary function is opening, closing, or restricting fluid ports. Multiple port sizes may be used where the flow area is increased or restricted by the displacement of the sleeves.

For example, FIGS. 16 and 17 partially illustrate alternate shifting sleeve device 710. Except as otherwise noted, elements of device 710 with the same reference numbers as corresponding elements in device 10 and/or device 610 have the same components, features, and characteristics as described above in connection with the corresponding elements in device 10 and/or device 610. Shifting sleeve device 710 may be configured to open and/or close a port, or to sequentially open and/or close a series of ports. Alternate shifting sleeve device 710 may include upper segment 712 and lower segment 714, both slidingly disposed within inner bores of first housing 716, second housing 718, port housing 720, third housing 722, and end member 440. Lower segment 714 may be disposed within inner bore 724 of port housing 720. Port housing 720 may include one or more ports 726 fluidly connecting an outer wall of port housing 720 to inner bore 724. In a first position shown in FIG. 16, lower segment 714 blocks or otherwise fluidly seals ports 726 to prevent fluid flow therethrough. Shifting lower segment 714 to a second position shown in FIG. 17 opens ports 726 to allow fluid flow therethrough.

Lower segment 714 may include hanging member 400, bridge member 432, and retaining sleeve 434. A shifting sleeve of lower segment 714 may include inner sleeve 530 and seat member 728. Seat member 728 may include inner bore 730 having a restricted diameter shoulder to form seat surface 732. Seat member 728 may be threadedly connected to a lower end of inner sleeve 530. Seat member 728 may also be selectively attached to retaining sleeve 434. In one embodiment, pin members 484 may engage apertures in the lower end of retaining sleeve 434 and one or more bores in the upper end of seat member 728 to secure seat member 728 to retaining sleeve 434. Inner bore 730 of seat member 728 may also include grooves configured to receive seal members to fluidly seat the connection between seat member 728 and inner sleeve 530.

Upper segment 712 may include retaining sleeve 34. A shifting sleeve of upper segment 712 may include inner sleeve 130, flapper frame 620, and frame assembly 622. Upper segment 712 may also include hanging member 30 (not shown) and bridge member 32 (not shown), each having the same characteristics as the same components in upper segment 614 of device 610.

In the first position of lower segment 714 illustrated in FIG. 16, hanging member 400 may be at least partially disposed within the inner bore of flapper body 632 of upper segment 712 to retain flapper ball seat 630 in the retracted position. Lower segment 714 may be secured in the first position by inner sleeve 530 retaining each retainer 416 in engagement with groove 734 in inner bore 724 of port housing 720.

Referring again to FIG. 16, alternate shifting sleeve device 710 may be lowered into a wellbore with upper segment 712 and lower segment 714 each in the first position. When port housing 720 reaches a desired location within the wellbore, plug 740 (shown in FIG. 17) may be pumped through the central bore of device 710. Plug 740 may engage and be stopped by seat surface 732 of the shifting sleeve of lower segment 714. Plug 740 may be any object capable of sealing inner bore 730 of seat member 728 by engaging seat surface 732 as described in connection with plug 600 above.

Pumping a fluid into the central bore of device 710 above plug 740 may shear pin members 484, thereby allowing seat member 728 along with inner sleeve 530 to move in a downward direction within the inner bores of hanging member 400, bridge member 432, and retaining sleeve 434 from the first position (shown in FIG. 16) into the second position (shown in FIG. 17). This movement causes inner sleeve 530 to no longer maintain retainers 416 in engagement with groove 734 of port housing 720. With lower segment 714 disengaged from port housing 720, continued fluid pressure slides lower segment 714 within the inner bore of housing 722 to the second position shown in FIG. 17. A lower shoulder within inner bore of end member 440 may engage lower segment 714 to secure lower segment 714 in the second position. In the second position, hanging member 400 may separate from upper segment 712.

In the first position shown in FIG. 16, bridge member 432 is aligned with ports 726 of port housing 720. In the second position shown in FIG. 17, hanging member 400 is aligned with ports 726. Because the outer diameter of bridge member 432 is greater than the outer diameter of hanging member 400, ports 726 are closed in the first position and open in the second position. Accordingly, shifting lower segment 714 from the first position into the second position opens ports 726 to provide fluid paths 742 between the inner bore of device 710 and the outside of plug housing 720 (in either direction).

When hanging member 400 of lower segment 714 slides out of flapper assembly 622, flapper ball seat 630 pivots from the retracted position (shown in FIG. 16) to the deployed position (shown in FIG. 17) to form a seat surface of upper segment 712. Thereafter, a plug may be pumped through device 710 to slide the shifting sleeve of upper segment 712 from the first position into the second position to effectively close ports 726 and fluid paths 742. Alternatively, sliding the shifting sleeve of upper segment 712 into the second position may effectively open ports of an upper port housing (not shown). In another alternative, sliding the shifting sleeve of upper segment 712 into the second position may effectively close ports 726 and open ports of an upper port housing (not shown).

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A downhole shifting sleeve device configured for attachment to a tubular string within a wellbore, the downhole shifting sleeve device comprising:

an upper segment including:

a housing including an inner bore;

a lower suspension member operatively connected below the housing, the lower suspension member including an inner bore;

an inner sleeve having a sleeve inner bore, the inner sleeve configured to slide from a first position to a second position within the inner bore of the housing; and a seat assembly slidingly disposed within the inner bore of the housing, wherein an upper end of the seat assembly is attached to a lower end of the inner sleeve, wherein in a retracted position an inner diameter of the seat assembly is greater than or equal to a diameter of the sleeve inner bore, and wherein in a deployed position the inner diameter of the seat assembly is less than the diameter of the sleeve inner bore to form a seat surface; and a releasable portion selectively connected within the inner bore of the lower suspension member and within a central space of the seat assembly of the upper segment, the releasable portion extending below the upper segment;

wherein in an engaged position the releasable portion engages the inner bore of the lower suspension member and the central space of the seat assembly of the upper segment to maintain the seat assembly in the retracted position, and wherein in a released position the releasable portion is disconnected from the upper segment to place the seat assembly into the deployed position.

2. The downhole shifting sleeve device of claim 1, further including an upper suspension sleeve configured for operative attachment to the tubular string, the upper suspension sleeve including an inner bore; wherein the upper segment further includes:

a hanging member including a retainer and an inner bore, the hanging member selectively connected to the inner bore of the upper suspension sleeve, wherein the housing is operatively connected below the hanging member, and wherein the inner sleeve is also slidingly disposed within the inner bore of the hanging member;

wherein in the first position the inner sleeve is configured to maintain the retainer in engagement with the inner bore of the upper suspension sleeve to operatively connect the upper segment to the upper suspension sleeve in an engaged position of the upper segment; and wherein in the second position the inner sleeve is configured to release the retainer from the inner bore of the upper suspension sleeve to place the upper segment in a released position in which the upper segment is disconnected from the upper suspension sleeve.

3. The downhole shifting sleeve device of claim 2, further comprising a plug dimensioned to engage the seat surface of the seat assembly of the upper segment for sliding the inner sleeve from the first position into the second position to transfer the upper segment from the engaged position to the released position.

4. The downhole shifting sleeve device of claim 2, wherein the retainer of the hanging member of the upper segment comprises a spherical member, a dart, a tapered insert, or a tapered segment.

5. The downhole shifting sleeve device of claim 2, wherein the releasable portion includes a lower segment including:

a hanging member including a retainer and an inner bore, the hanging member selectively connected to the inner bore of the lower suspension member and the seat assembly of the upper segment;

a housing operatively connected below the hanging member, the housing including an inner bore;

an inner sleeve having a sleeve inner bore, the inner sleeve configured to slide from a first position to a second position within the inner bore of the hanging member and the inner bore of the housing; and a seat member slidingly disposed within the inner bore of the housing, the seat member including a restricted diameter inner bore, wherein an upper end of the seat member is attached to a lower end of the inner sleeve;

wherein in the first position the inner sleeve is configured to maintain the retainer in engagement with the inner bore of the lower suspension member of the upper segment to operatively connect the lower segment to the upper segment in an engaged position of the lower segment; wherein in the engaged position of the lower segment the hanging member maintains the seat assembly of the upper segment in the retracted position; wherein in the second position the inner sleeve is configured to release the retainer from the inner bore of the lower suspension member of the upper segment to place the lower segment in a released position in which the lower segment is disconnected from the upper segment; and wherein in the released position of the lower segment the hanging member transfers the seat assembly of the upper segment into the deployed position.

6. The downhole shifting sleeve device of claim 5, further comprising:

a first plug dimensioned to engage the restricted diameter inner bore of the seat member of the lower segment for sliding the inner sleeve of the lower segment from the first position to the second position to place the lower segment in the released position for disconnecting the lower segment from the upper segment; and a second plug dimensioned to engage the seat surface of the seat assembly of the upper segment for sliding the inner sleeve of the upper segment from the first position to the second position to place the upper segment in the released position for disconnecting the lower segment from the upper segment;

wherein a diameter of the first plug is approximately equal to a diameter of the second plug.

7. The downhole shifting sleeve device of claim 2, wherein the releasable portion includes a middle segment and a lower segment each separately releasable.

8. The downhole shifting sleeve device of claim 7, wherein the middle segment includes:

a hanging member including a retainer and an inner bore, the hanging member selectively connected within the inner bore of the lower suspension member and the seat assembly of the upper segment;

a housing operatively connected below the hanging member, the housing including an inner bore;

a lower suspension member operatively connected below the housing, the lower suspension member including an inner bore;

an inner sleeve having a sleeve inner bore, the inner sleeve configured to slide from a first position to a second position within the inner bore of the hanging member and the inner bore of the housing; and a seat assembly slidingly disposed within the inner bore of the housing, wherein an upper end of the seat assembly is attached to a lower end of the inner sleeve, wherein in a retracted position an inner diameter of the seat assembly is greater than or equal to a diameter of the sleeve inner bore, and wherein in a deployed position the inner diameter of the seat assembly is less than the diameter of the sleeve inner bore to form a seat surface in the middle segment;

wherein in the first position the inner sleeve is configured to maintain the retainer in engagement with the inner bore of the lower suspension member of the upper segment to operatively connect the middle segment to the upper segment in an engaged position of the middle segment; wherein in the engaged position of the middle segment the hanging member maintains the seat assembly of the upper segment in the retracted position; wherein in the second position the inner sleeve is configured to release the retainer from the inner bore of the lower suspension member of the upper segment to place the middle segment in a released position in which the middle segment is disconnected from the upper segment; and wherein in the released position of the middle segment the hanging member transfers the seat assembly of the upper segment into the deployed position.

9. The downhole shifting sleeve device of claim 8, wherein the lower segment includes:

a hanging member including a retainer and an inner bore, the hanging member selectively connected within the inner bore of the lower suspension member and the seat assembly of the middle segment;

a housing operatively connected below the hanging member, the housing including an inner bore;

an inner sleeve having a sleeve inner bore, the inner sleeve configured to slide from a first position to a second position within the inner bore of the hanging member and the inner bore of the housing; and a seat member slidingly disposed within the inner bore of the housing, the seat member including a restricted diameter inner bore, wherein an upper end of the seat member is attached to a lower end of the inner sleeve;

wherein in the first position the inner sleeve is configured to maintain the retainer in engagement with the inner bore of the lower suspension member of the middle segment to operatively connect the lower segment to the middle segment in an engaged position of the lower segment; wherein in the engaged position of the lower segment the hanging member maintains the seat assembly of the middle segment in the retracted position; wherein in the second position the inner sleeve is configured to release the retainer from the inner bore of the lower suspension member of the middle segment to place the lower segment in a released position in which the lower segment is disconnected from the middle segment; and wherein in the released position of the lower segment the hanging member transfers the seat assembly of the middle segment into the deployed position.

10. The downhole shifting sleeve device of claim 9, further comprising:

a first plug dimensioned to engage the restricted diameter inner bore of the seat member of the lower segment for sliding the inner sleeve of the lower segment from the first position to the second position to place the lower segment in the released position for disconnecting the lower segment from the middle segment;

a second plug dimensioned to engage the seat surface of the seat assembly of the middle segment for sliding the inner sleeve of the middle segment from the first position to the second position to place the lower segment in the released position for disconnecting the middle segment from the upper segment; and a third plug dimensioned to engage the seat surface of the seat assembly of the upper segment for sliding the inner sleeve of the upper segment from the first position to the second position to place the lower segment in the released position for disconnecting the upper segment from the upper suspension sleeve;

wherein a diameter of the first plug is approximately equal to a diameter of the second plug and a diameter of the third plug.

11. The downhole shifting sleeve device of claim 1, wherein the seat assembly of the upper segment includes a seat sleeve and a segmented seat housed within an inner cavity of the seat sleeve, the segmented seat defining the inner diameter of the seat assembly, wherein the segmented seat comprises a split ring having two or more segments that are separated by a distance in the retracted position and in contact with one another in the deployed position to form the seat surface.

12. The downhole shifting sleeve device of claim 11, wherein each segment of the split ring includes an outer tapered surface configured to cooperate with a tapered inner surface of the inner cavity of the seat sleeve.

13. The downhole shifting sleeve device of claim 12, wherein the upper segment further includes a spring configured to operatively bias the segmented seat toward the deployed position.

14. The downhole shifting sleeve device of claim 13, wherein the upper segment further includes a spring frame having an outer surface with an upper portion and a lower portion interconnected by a shoulder, wherein the upper portion of the spring frame is affixed to a lower end of the inner sleeve, wherein an upper end of the seat sleeve is affixed to the upper portion of the spring frame, wherein the shoulder of the spring frame engages an upper end of the spring, wherein the spring is disposed between the seat sleeve and the lower portion of the outer surface of the spring frame.

15. The downhole shifting sleeve device of claim 14, wherein the upper segment further includes a guide having an upper end surface and a lower end surface, wherein the lower end surface engages the segments of the segmented seat, and wherein a lower end of the spring engages the upper end surface of the guide to bias the guide toward the segmented seat and to bias the segmented seat toward the deployed position.

16. The downhole shifting sleeve device of claim 1, further comprising one or more wiper blades disposed around an outer surface of the housing of the upper segment.

17. The downhole shifting sleeve device of claim 1, wherein the seat assembly of the upper segment includes a flapper assembly having a flapper ball seat pivotally movable between the retracted position and the deployed position.

18. A downhole shifting sleeve device configured for attachment to a tubular string within a wellbore, the downhole shifting sleeve device comprising:

a housing having a housing inner bore;

a first segment disposed within the housing inner bore, the first segment including:

a first sleeve having a first sleeve inner bore, the first sleeve configured to slide from a first position to a second position within the housing inner bore;

a first seat surface disposed within the housing inner bore and operatively connected to the first sleeve, wherein an inner diameter of the first seat surface is less than a diameter of the first sleeve inner bore, wherein the first segment is configured to transfer the first sleeve from the first position to the second position when a plug engages the first seat surface;

a second segment disposed within the housing inner bore, the second segment including:

a second sleeve having a second sleeve inner bore, the second sleeve configured to slide from a first position to a second position within the housing inner bore; and a second seat assembly disposed within the housing inner bore and operatively connected to the second sleeve, wherein in a retracted position an inner diameter of the second seat assembly is greater than or equal to a diameter of the second sleeve inner bore, wherein in a deployed position the inner diameter of the second seat assembly is less than the diameter of the second sleeve inner bore to form a second seat surface, wherein the second seat assembly is in the retracted position when the first sleeve is in the first position and in the deployed position when the first sleeve is in the second position, and wherein the second segment is configured to transfer the second sleeve from the first position to the second position when a plug engages the second seat surface of the second seat assembly in the deployed position.

19. The downhole shifting sleeve device of claim 18, wherein the housing includes a fluid port through an outer wall, wherein in the first position the first sleeve closes the fluid port, and wherein in the second position of the first sleeve the fluid port is open.

20. The downhole shifting sleeve device of claim 18, wherein the housing includes a fluid port through an outer wall, wherein in the first position of the first sleeve the fluid port is open, and wherein in the second position the first sleeve closes the fluid port.

21. A method of using a shifting sleeve device in a wellbore, comprising the steps of:

a) providing a shifting sleeve device comprising:

i) an upper segment including: a housing having an inner bore; a lower suspension member operatively connected below the housing, the lower suspension member including an inner bore; an inner sleeve having a sleeve inner bore, the inner sleeve configured to slide from a first position to a second position within the inner bore of the housing; and a seat assembly slidingly disposed within the inner bore of the housing, wherein an upper end of the seat assembly is attached to a lower end of the inner sleeve, wherein in a retracted position an inner diameter of the seat assembly is greater than or equal to an inner diameter of the inner sleeve, and wherein in a deployed position the inner diameter of the seat assembly is less than the inner diameter of the inner sleeve to form a seat surface of the upper segment; and ii) a lower segment including: a hanging member including a retainer and an inner bore, the hanging member selectively connected within the inner bore of the lower suspension member and within a central space of the seat assembly of the upper segment; a housing operatively connected below the hanging member, the housing including an inner bore; an inner sleeve having a sleeve inner bore, the inner sleeve configured to slide from a first position to a second position within the inner bore of the hanging member and the inner bore of the housing; and a seat member slidingly disposed within the inner bore of the housing, the seat member including a restricted diameter inner bore, wherein an upper end of the seat member is attached to a lower end of the inner sleeve;

b) attaching the shifting sleeve device to a tubular string;

c) running the tubular string with the shifting sleeve device into a wellbore with the inner sleeve of the upper segment and the inner sleeve of the lower segment each in the first position; wherein the inner sleeve of the lower segment in the first position maintains the retainer of the lower segment in engagement with the inner bore of the lower suspension member of the upper segment in an engaged position of the lower segment; and wherein the hanging member of the lower segment is disposed within the inner bore of the lower suspension member and within the central space of the seat assembly of the upper segment to maintain the seat assembly of the upper segment in the retracted position;

d) deploying a plug through the tubular string and through the shifting sleeve device such that the plug engages the restricted diameter inner bore of the seat member of the lower segment; and e) disconnecting the lower segment from the upper segment by increasing a fluid pressure on the plug to slide the inner sleeve of the lower segment from the first position to the second position in which the inner sleeve of the lower segment releases the retainer from the inner bore of the lower suspension member of the upper segment to disconnect the lower segment from the upper segment, thereby releasing the hanging member from the inner bore of the lower suspension member and the central space of the seat assembly of the upper segment to place the seat assembly of the upper segment in the deployed position to form the seat surface of the upper segment.

22. The method of claim 21, wherein the shifting sleeve device further includes an upper suspension sleeve having an inner bore, wherein the upper segment further includes a hanging member including a retainer and an inner bore, the hanging member selectively connected to the inner bore of the upper suspension sleeve, wherein the housing of the upper segment is operatively connected below the hanging member, and wherein the inner sleeve of the upper segment is also slidingly disposed within the inner bore of the hanging member;

wherein step (b) further includes attaching the upper suspension sleeve to the tubular string;

wherein in step (c) the inner sleeve of the upper segment in the first position maintains the retainer of the upper segment in engagement with the inner bore of the upper suspension sleeve in an engaged position of the upper segment.

23. The method of claim 22, further comprising the steps of:

f) deploying a second plug through the tubular string and through the shifting sleeve device such that the second plug engages the seat surface of the upper segment; and g) disconnecting the upper segment from the upper suspension sleeve by increasing a fluid pressure on the second plug to slide the inner sleeve of the upper segment from the first position to the second position in which the inner sleeve of the upper segment releases the retainer from the inner bore of the upper suspension sleeve to disconnect the upper segment from the upper suspension sleeve.

* * * * *